US009746798B2

(12) United States Patent
Sato

(10) Patent No.: US 9,746,798 B2
(45) Date of Patent: Aug. 29, 2017

(54) DEVELOPING DEVICE INCLUDING CASING HAVING SUPPLY OPENING AND DISCHARGE OPENING, AND IMAGE FORMING APPARATUS PROVIDED WITH THE SAME

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/066,147

(22) Filed: Mar. 10, 2016

(65) Prior Publication Data

US 2016/0291506 A1 Oct. 6, 2016

(30) Foreign Application Priority Data

Mar. 31, 2015 (JP) ..... 2015-073380

(51) Int. Cl.
*G03G 15/08* (2006.01)
*G03G 21/16* (2006.01)

(52) U.S. Cl.
CPC ..... *G03G 15/0812* (2013.01); *G03G 15/0806* (2013.01); *G03G 15/0808* (2013.01);
(Continued)

(58) Field of Classification Search
CPC ..... G03G 21/1647; G03G 21/186; G03G 2221/1654; G03G 2221/1657; G03G 2215/0119
See application file for complete search history.

(56) References Cited

U.S. PATENT DOCUMENTS

2010/0202803 A1* 8/2010 Sato ..... G03G 15/0896 399/263
2010/0215401 A1* 8/2010 Fujiwara ..... G03G 15/09 399/119

(Continued)

FOREIGN PATENT DOCUMENTS

JP 2011-095578 A 5/2011

*Primary Examiner* — Walter L Lindsay, Jr.
*Assistant Examiner* — Jessica L Eley
(74) *Attorney, Agent, or Firm* — Banner & Witcoff, Ltd.

(57) ABSTRACT

A developing device includes: a casing having a partitioning wall, a toner chamber, and a developing chamber positioned above the toner chamber; a photosensitive drum; a developing roller; a supply roller; first and second conveying members. The developing roller, the supply roller, and the second conveying member are accommodated in the developing chamber. The first conveying member is accommodated in the toner chamber. The partitioning wall has a supply opening and a discharge opening for providing communication between the toner chamber and the developing chamber. The supply and discharge openings are positioned outward of the supply roller in an axial direction of the photosensitive drum. The first conveying member conveys the toner accommodated in the toner chamber into the developing chamber through the supply opening. The second conveying member conveys the toner supplied by the first conveying member from the supply opening to the discharge opening in the axial direction.

14 Claims, 12 Drawing Sheets

(52) U.S. Cl.
CPC ..... *G03G 15/0891* (2013.01); *G03G 21/1676* (2013.01); *G03G 15/0865* (2013.01)

(56) References Cited

U.S. PATENT DOCUMENTS

2011/0103844 A1* 5/2011 Sato ..... G03G 15/0839 399/262
2013/0287435 A1* 10/2013 Yamamoto ..... G03G 15/0806 399/113

* cited by examiner

3

3

DEVELOPING DEVICE INCLUDING CASING HAVING SUPPLY OPENING AND DISCHARGE OPENING, AND IMAGE FORMING APPARATUS PROVIDED WITH THE SAME

CROSS REFERENCE TO RELATED APPLICATION

This application claims priority from Japanese Patent Application No. 2015-073380 filed Mar. 31, 2015. The entire content of the priority application is incorporated herein by reference.

TECHNICAL FIELD

The present disclosure relates to a developing device used in an electrophotographic type image forming apparatus, and to an image forming apparatus provided with the developing device.

BACKGROUND

There is conventionally known an electrophotographic type image forming apparatus including a toner box accommodating toner therein, and a developing device positioned upward of the toner box and provided with a photosensitive drum.

In this image forming apparatus, the toner box is formed with a supply opening at an intermediate portion thereof in an axial direction of the photosensitive drum, and return openings each being formed at each end portion of the toner box in the axial direction. Toner accommodated in the toner box is supplied to the developing device through the supply opening. Toner that has been supplied into the developing device is conveyed in the axial direction by an auger provided in the developing device, and is returned into the toner box through the return openings. Toner supplied to the developing device is supplied by a supply roller to a developing roller positioned upward of the supply roller while the toner is conveyed in the axial direction, and then, the toner supplied to the developing roller is supplied to the photosensitive drum positioned upward of the developing roller.

SUMMARY

However, in this image forming apparatus, toner is conveyed from an axially intermediate position to axially outward positions in the developing device. Therefore, an amount of toner at an axially intermediate portion of the developing device may be different from an amount of toner at each axial end portion of the developing device.

In this case, a toner supply amount to the photosensitive drum may be different between the axially intermediate portion and the axial end portion. Accordingly, imaging quality may not be uniform in the axial direction in view of density.

In particular, in the toner conveying structure in which toner in the toner box is conveyed upward as performed in the above-described image forming apparatus, toner supply from the toner box to the developing roller using gravity of the toner cannot be performed. Consequently, non-uniform toner supply to the photosensitive drum may occur if the toner amount in the developing device is not uniform in the axial direction.

In view of the foregoing, it is an object of the disclosure to provide a developing device capable of uniformly supplying toner to a photosensitive drum in an axial direction thereof, and to provide an image forming apparatus provided with the developing device.

In order to attain the above and other objects, according to one aspect, the disclosure provides a developing device including: a casing; a photosensitive drum; a developing roller; a supply roller; a first conveying member; and a second conveying member. The casing defines an internal space therein and has a partitioning wall partitioning the internal space into a toner chamber and a developing chamber. The toner chamber accommodates toner therein. The developing chamber is positioned upward of the toner chamber. The partitioning wall has a supply opening and a discharge opening for providing communication between the toner chamber and the developing chamber. The photosensitive drum is configured to rotate about a first axis extending in an axial direction. The developing roller is accommodated in the developing chamber and configured to supply toner to the photosensitive drum. The developing roller is configured to rotate about a second axis. The supply roller is accommodated in the developing chamber and configured to supply toner to the developing roller. The supply roller is configured to rotate about a third axis positioned downward of the second axis. The supply opening and the discharge opening are positioned outward of the supply roller in the axial direction. The first conveying member is accommodated in the toner chamber and configured to convey the toner accommodated in the toner chamber into the developing chamber through the supply opening. The first conveying member is configured to rotate about a fourth axis positioned downward of the third axis. The second conveying member is accommodated in the developing chamber and configured to convey the toner supplied by the first conveying member from the supply opening to the discharge opening in the axial direction.

According to another aspect, the disclosure provides an image forming apparatus including: a developing device; and an exposure unit. The developing device includes: a casing; a photosensitive drum; a developing roller; a supply roller; a first conveying member; and a second conveying member. The casing defines an internal space therein and has a partitioning wall partitioning the internal space into a toner chamber and a developing chamber. The toner chamber accommodates toner therein. The developing chamber is positioned upward of the toner chamber. The partitioning wall has a supply opening and a discharge opening for providing communication between the toner chamber and the developing chamber. The photosensitive drum is configured to rotate about a first axis extending in an axial direction. The developing roller is accommodated in the developing chamber and configured to supply toner to the photosensitive drum. The developing roller is configured to rotate about a second axis. The supply roller is accommodated in the developing chamber and configured to supply toner to the developing roller. The supply roller is configured to rotate about a third axis positioned downward of the second axis. The supply opening and the discharge opening are positioned outward of the supply roller in the axial direction. The first conveying member is accommodated in the toner chamber and configured to convey the toner accommodated in the toner chamber into the developing chamber through the supply opening. The first conveying member is configured to rotate about a fourth axis positioned downward of the third axis. The first conveying member includes: a shaft extending in the axial direction; a first blade disposed at a position coincident with the supply opening in the axial direction, the first blade extending from the shaft toward an inner surface of the casing; and a second blade positioned closer to the discharge opening than the first blade to the discharge opening in the axial direction, the second blade extending from the shaft toward the inner surface of the casing, the second blade having a flexibility higher than that of the first blade. The second conveying member is accommodated in the developing chamber and configured to convey the toner supplied by the first conveying member from the supply opening to the discharge opening in the axial direction. The casing includes: a first accommodating wall accommodating the first blade and having an inner surface formed in an arcuate shape; and a second accommodating wall accommodating the second blade and having an inner surface extending linearly. The second accommodating wall is positioned closer to the discharge opening than the first accommodating wall to the discharge opening in the axial direction. The exposure unit is positioned downward of the casing. The exposure unit is configured to emit a laser beam to expose the photosensitive drum to the laser beam. The second accommodating wall extends along a path through which the laser beam passes.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
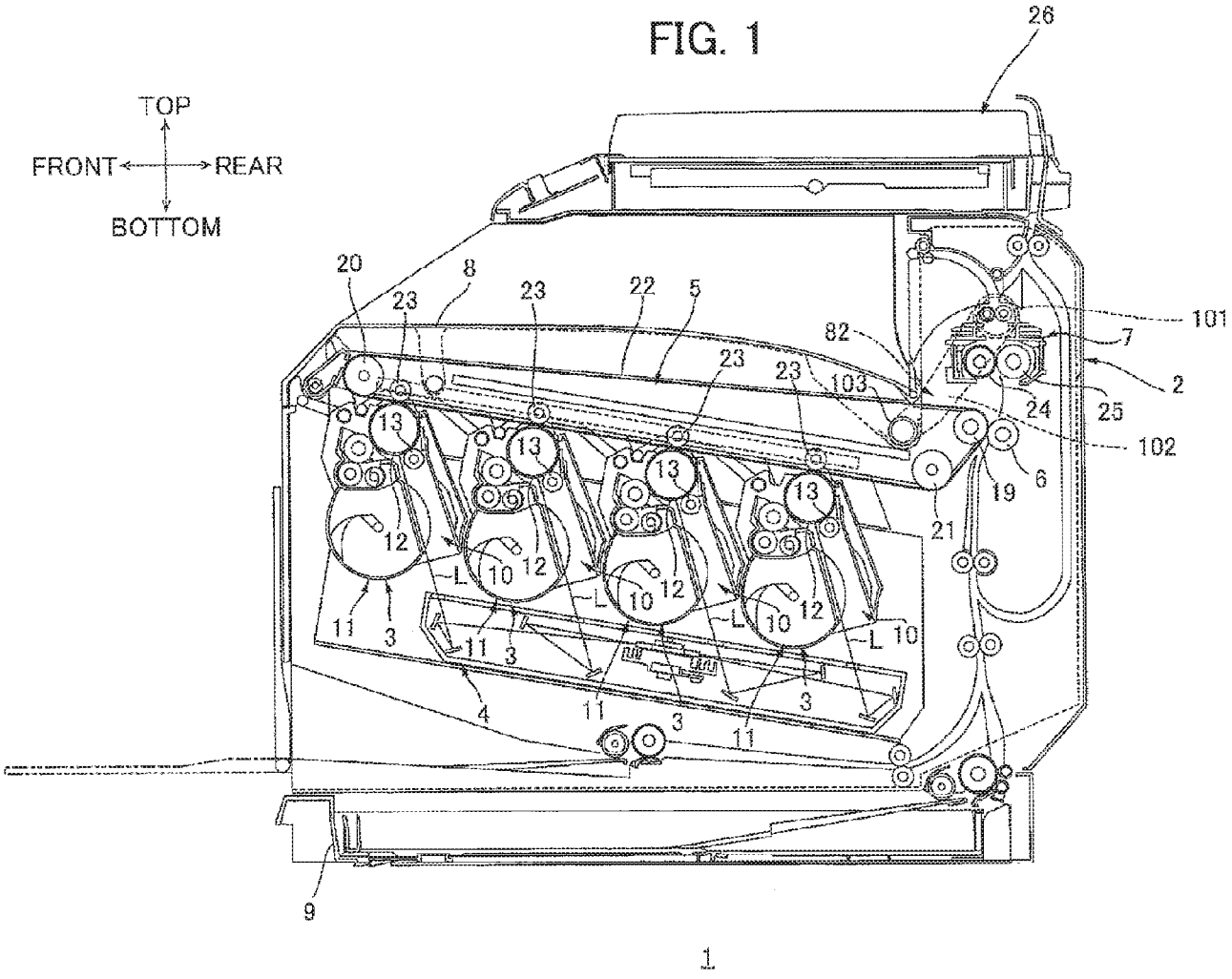
FIG. 1 is a central cross-sectional view of an image forming apparatus provided with a developing device according to one embodiment.

An image forming apparatus 1 provided with a plurality of developing devices 3 according to one embodiment will be described with reference to the accompanying drawings, wherein like parts and components are designated by the same reference numerals to avoid duplicating description. Directions referred to in the following description are based on directions indicated in the drawings.

1. Overall Structure of Image Forming Apparatus

As shown in FIG. 1, the image forming apparatus 1 is a laser printer. The image forming apparatus 1 includes a main casing 2 formed with an opening 2A (FIG. 12); a plurality of (four) developing devices 3; an exposure unit 4; a belt unit 5; a secondary transfer roller 6; a fixing unit 7; and a reading unit 26.

The main casing 2 is box-shaped, and is provided with a cover 8 and a supply tray 9.

Figure 12:
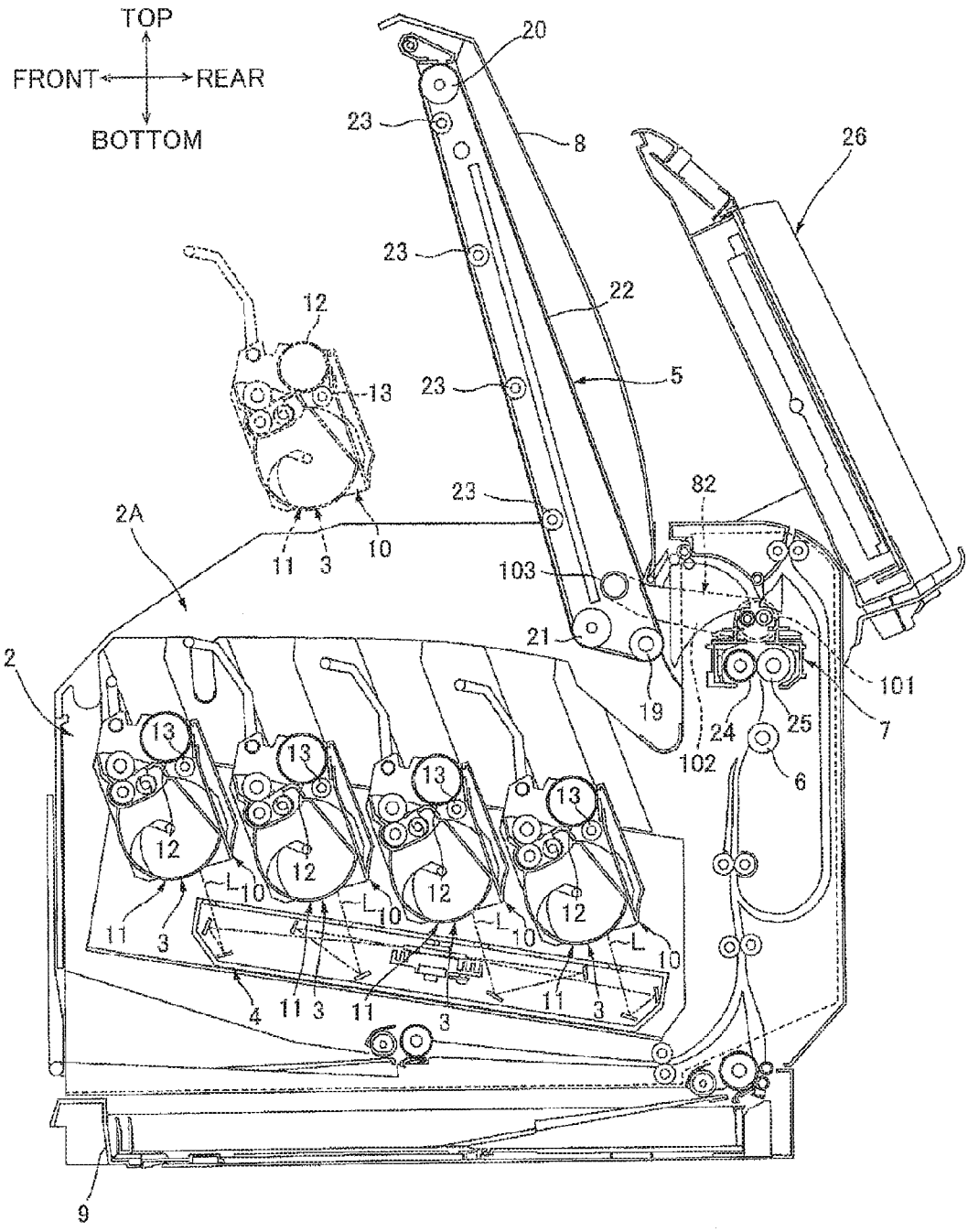
FIG. 12 is a view illustrating how the developing device is mounted in and removed from a main casing of the image forming apparatus.

As shown in FIG. 12, the opening 2A is positioned at an upper end portion of the main casing 2 to provide communication between an interior and exterior of the main casing 2 in a vertical direction. The opening 2A allows the plurality of developing devices 3 to pass therethrough.

As shown in FIG. 1, the cover 8 is disposed at the upper end portion of the main casing 2. The cover 8 has a plate shape that extends in a front-rear direction. The cover 8 is pivotally movable together with the belt unit 5 about an axis of pivot shafts 101 of a pivot member 82 (described later) between an open position opening the opening 2A (FIG. 12) and a closed position closing the opening 2A (FIG. 1).

The supply tray 9 is disposed at a lower end portion of the main casing 2. The supply tray 9 is configured to accommodate sheets P.

Figure 2:
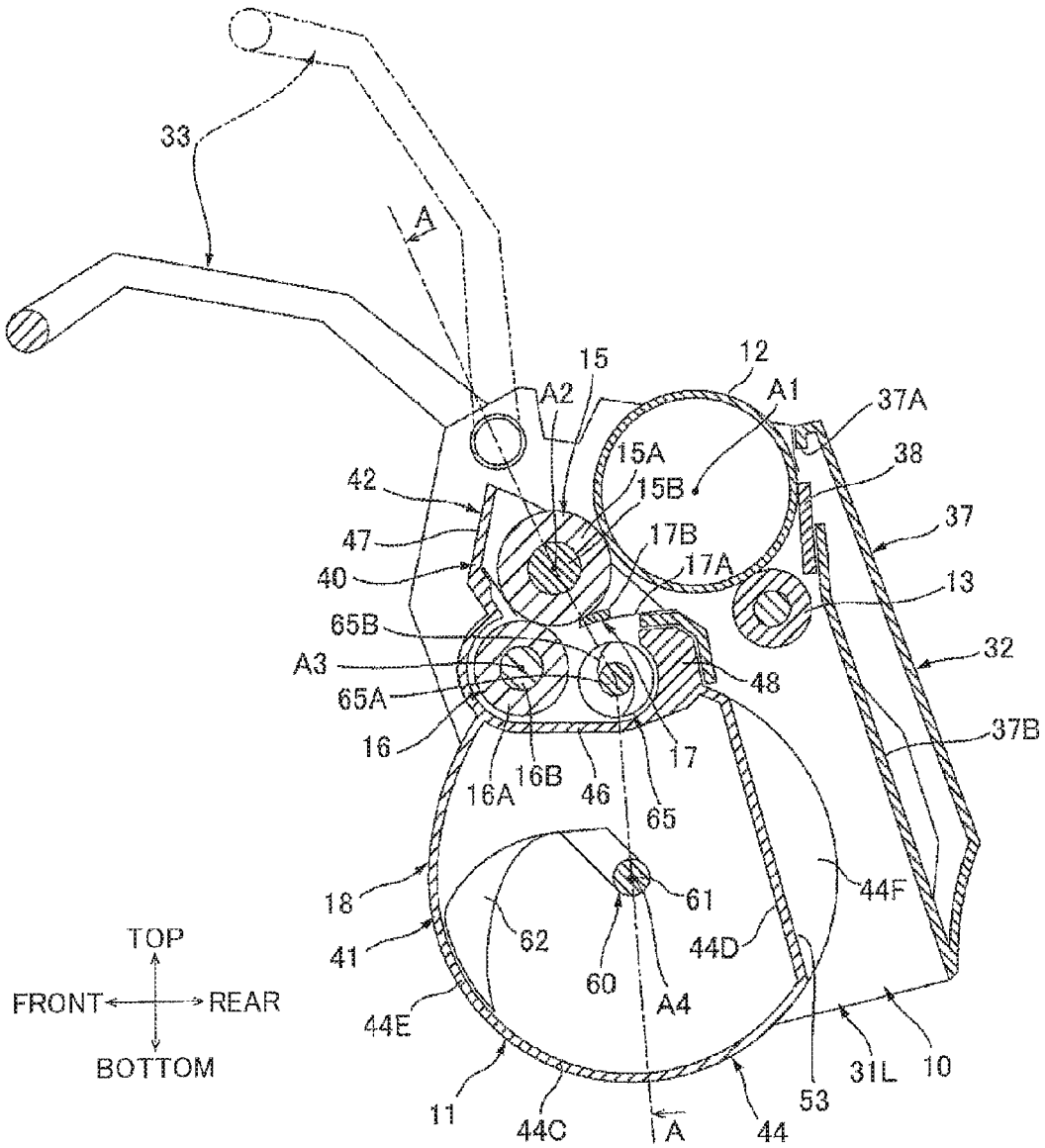
FIG. 2 is a central cross-sectional view of the developing device shown in FIG. 1.

The plurality of developing devices 3 is each a process cartridge. The plurality of developing devices 3 is detachable from and attachable to the main casing 2. When attached to the main casing 2, the four developing devices 3 are arrayed in the front-rear direction with a space between neighboring developing devices 3. Each developing device 3 can be detached from the main casing 2 to an outside through the opening 2A as shown in FIG. 12. As shown in FIG. 2, each of the four developing devices 3 includes a drum unit 10 and a developing unit 11.

The drum unit 10 includes a photosensitive drum 12 and a charging roller 13.

The photosensitive drum 12 is positioned at an upper end portion of the drum unit 10. The photosensitive drum 12 has a cylindrical shape that extends in a left-right direction (an example of an axial direction). The photosensitive drum 12 is rotatable about a first axis A1 extending in the left-right direction.

The charging roller 13 is positioned downward of the photosensitive drum 12. The charging roller 13 is in contact with a lower end portion of the photosensitive drum 12. The charging roller 13 is configured to charge a surface of the photosensitive drum 12.

The developing unit 11 is positioned diagonally forward and downward of the photosensitive drum 12. The developing unit 11 includes a developing roller 15, a supply roller 16, a blade 17, and a toner chamber 18.

The developing roller 15 is positioned at an upper end portion of the developing unit 11. The developing roller 15 is in contact with a lower-front end portion of the photosensitive drum 12. The developing roller 15 is configured to supply toner to the photosensitive drum 12. The developing roller 15 is rotatable about a second axis A2 positioned downward of the first axis A1.

The supply roller 16 is positioned diagonally forward and downward of the developing roller 15. The supply roller 16 is in contact with a lower-front end portion of the developing roller 15. The supply roller 16 is configured to supply toner to the developing roller 15. The supply roller 16 is rotatable about a third axis A3 positioned downward of the second axis A2.

The blade 17 is positioned diagonally rearward and downward of the developing roller 15. The blade 17 is in contact with a lower-rear end portion of the developing roller 15. The blade 17 is configured to regulate a thickness of a toner layer formed over a surface of the developing roller 15.

The toner chamber 18 is positioned downward of the supply roller 16. The toner chamber 18 has a cylindrical shape that extends in the left-right direction. The toner chamber 18 is configured to accommodate therein toner.

As shown in FIG. 1, the exposure unit 4 is positioned downward of the four developing devices 3. The exposure unit 4 is configured to irradiate a laser beam L based on image data. The laser beam L is incident on the surface of each photosensitive drum 12, passing between the developing unit 11 and the corresponding charging roller 13.

The belt unit 5 is positioned upward of the four developing devices 3, and extends in the front-rear direction. The belt unit 5 includes a first roller 19 positioned at a rear end portion of the belt unit 5; a second roller 20 positioned at a front end portion of the belt unit 5; a third roller 21 positioned diagonally forward and downward of the first roller 19; a belt 22; and a plurality of (four) primary transfer rollers 23.

The belt 22 is an endless belt looped over the first roller 19, the second roller 20, and the third roller 21. The belt 22 has a lower portion that is in contact with the four photosensitive drums 12. The belt 22 is circularly movable around the first roller 19, the second roller 20, and the third roller 21 such that the lower portion of the belt 22 is moved rearward.

The four primary transfer rollers 23 are arrayed in the front-rear direction between the second roller 20 and the third roller 21, with a space between neighboring primary transfer rollers 23. The primary transfer rollers 23 are positioned upward of the corresponding photosensitive drums 12, with the belt 22 interposed therebetween.

The secondary transfer roller 6 is positioned rearward of the first roller 19. The secondary transfer roller 6 nips the belt 22 in cooperation with the first roller 19.

The fixing unit 7 is positioned upward of the secondary transfer roller 6. The fixing unit 7 includes a heating roller 24, and a pressure roller 25 in pressure contact with the heating roller 24.

The reading unit 26 is positioned above the main casing 2. More specifically, the reading unit 26 is positioned upward of the cover 8 with a gap therebetween. The reading unit 26 is a flat-bed type image scanner. The reading unit 26 is configured to read image data from an original document.

Upon start of an image-forming operation in the image forming apparatus 1, the exposure unit 4 irradiates the laser beam L, so that the surfaces of the photosensitive drums 12 are exposed to the laser beam L. Thus, electrostatic latent images based on image data are formed on the surfaces of the photosensitive drums 12, respectively.

Then, toner is supplied onto the electrostatic latent images on the surfaces of the photosensitive drums 12 by the corresponding developing rollers 15. Thus, toner images are carried on the surfaces of the photosensitive drums 12.

Then, the toner images on the surfaces of the photosensitive drums 12 are transferred onto the belt 22.

In the meantime, the sheets P are supplied from the supply tray 9 one at a prescribed timing to a position between the belt 22 and the secondary transfer roller 6. The toner image on the belt 22 is transferred onto the sheet P when the sheet P passes between the belt 22 and the secondary transfer roller 6.

Subsequently, the sheet P is heated and pressed when the sheet P passes between the heating roller 24 and the pressure roller 25. Thus, the toner image carried on the sheet P is thermally fixed to the sheet P.

Then, the sheet P is delivered onto the cover 8.

2. Developing Device (1) Drum Unit

Figure 4A:
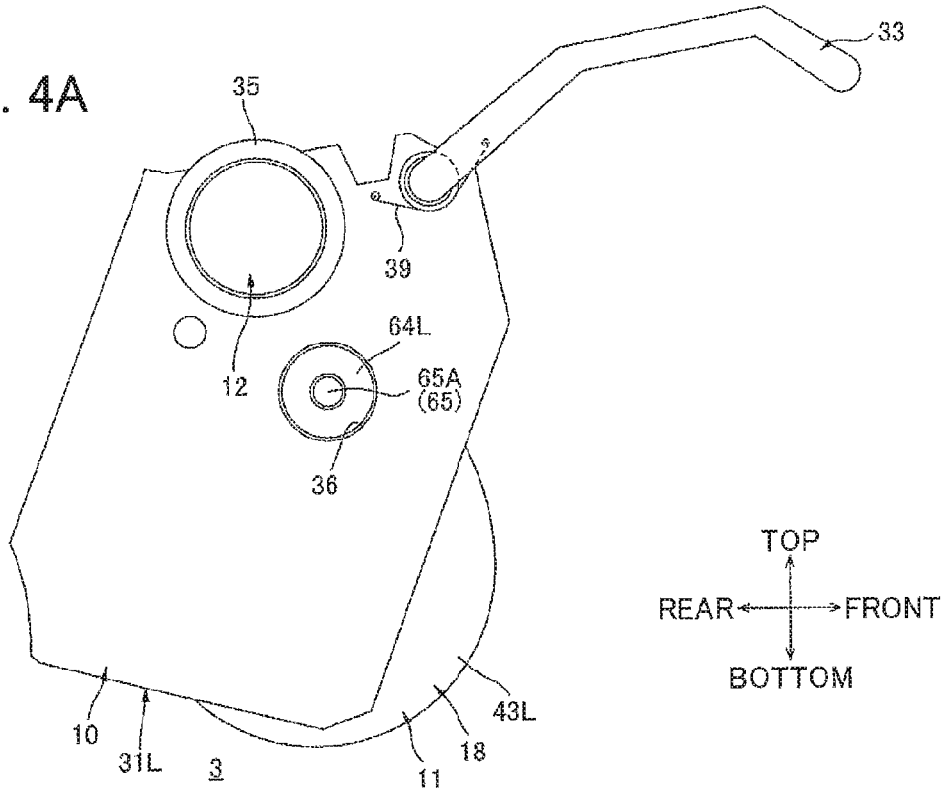
FIG. 4A is a left side view of the developing device shown in FIG. 2.
Figure 4B:
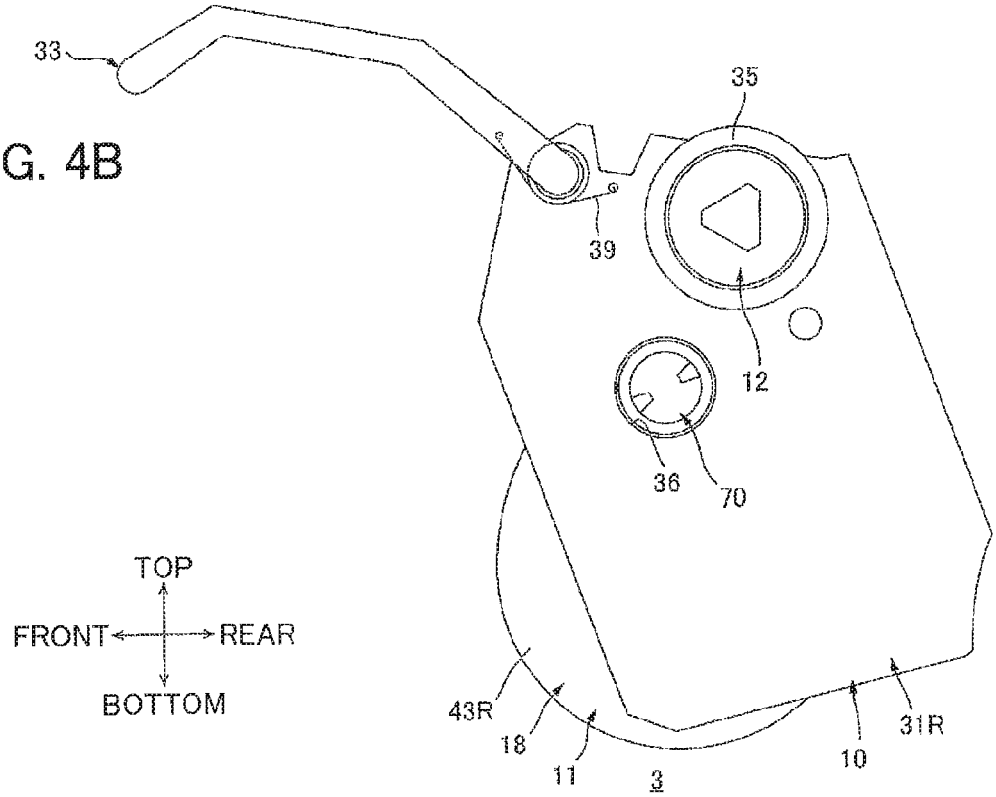
FIG. 4B is a right side view of the developing device shown in FIG. 2.

As shown in FIGS. 2, 4A, and 4B, the drum unit 10 includes a left side plate 31L having a hole 36 formed therein, a right side plate 31R having a hole 36 formed therein, a drum cleaner 32, and a handle 33.

Figure 3:
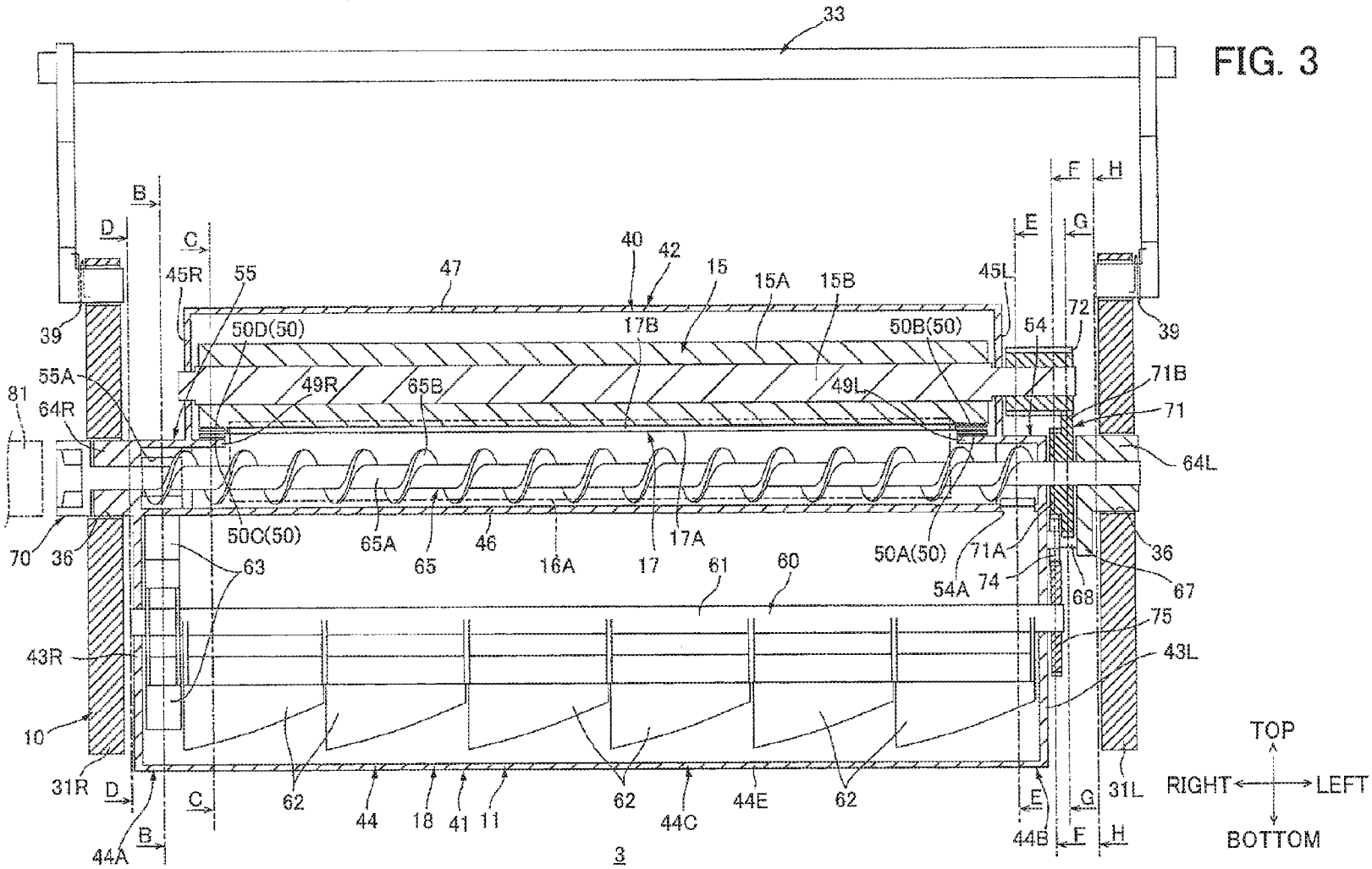
FIG. 3 is a cross-sectional view of the developing device taken along a line A-A in FIG. 2.

As shown in FIGS. 3 and 4A, the left side plate 31L is positioned at a left end portion of the drum unit 10. The left side plate 31L has a rectangular shape in a side view. The left side plate 31L is elongated both in the vertical direction and in the front-rear direction. The left side plate 31L includes a drum support part 35.

The drum support part 35 is positioned at a top end portion of the left side plate 31L. The drum support part 35 has a cylindrical shape that extends in the left-right direction. A left end portion of the photosensitive drum 12 is rotatably fitted in the drum support part 35.

The hole 36 is formed in the left side plate 31L at a position diagonally downward and forward of the drum support part 35. The hole 36 penetrates the left side plate 31L in the left-right direction. The hole 36 has a circular shape in a side view.

As shown in FIGS. 3 and 4B, the right side plate 31R is positioned at a right end portion of the drum unit 10. The right side plate 31R has a rectangular shape in a side view. The right side plate 31R is elongated both in the vertical direction and in the front-rear direction. Similar to the left side plate 31L, the right side plate 31R includes a drum support part 35. A right end portion of the photosensitive drum 12 is rotatably fitted in the drum support part 35 of the right side plate 31R.

As shown in FIG. 2, the drum cleaner 32 is positioned rearward of the photosensitive drum 12 and the charging roller 13. The drum cleaner 32 includes an accommodating portion 37, and a scraping blade 38.

The accommodating portion 37 has a flattened box shape and is elongated both in the vertical direction and in the left-right direction. The accommodating portion 37 is positioned between the left side plate 31L and the right side plate 31R. The accommodating portion 37 includes an opposing wall 37B having an opening 37A and a plurality of (two) recessed parts 37C (see FIGS. 7A and 11).

The opposing wall 37B constitutes a front wall of the accommodating portion 37. The opposing wall 37B extends linearly in a direction from upper front to lower rear.

The opening 37A is positioned at a top end portion of the opposing wall 37B. The opening 37A penetrates the top end portion of the opposing wall 37B in the front-rear direction. The opening 37A confronts a rear portion of a circumferential surface of the photosensitive drum 12.

Figure 7A:
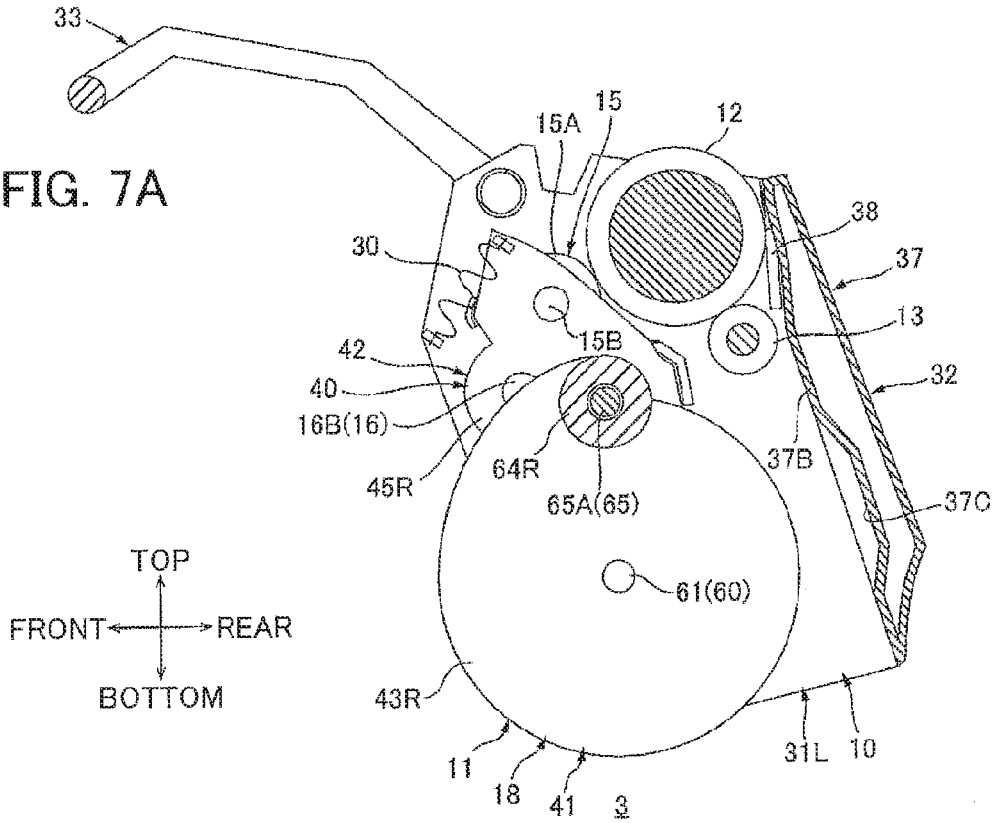
FIG. 7A is a cross-sectional view of the developing device taken along a line D-D in FIG. 3.
Figure 11:
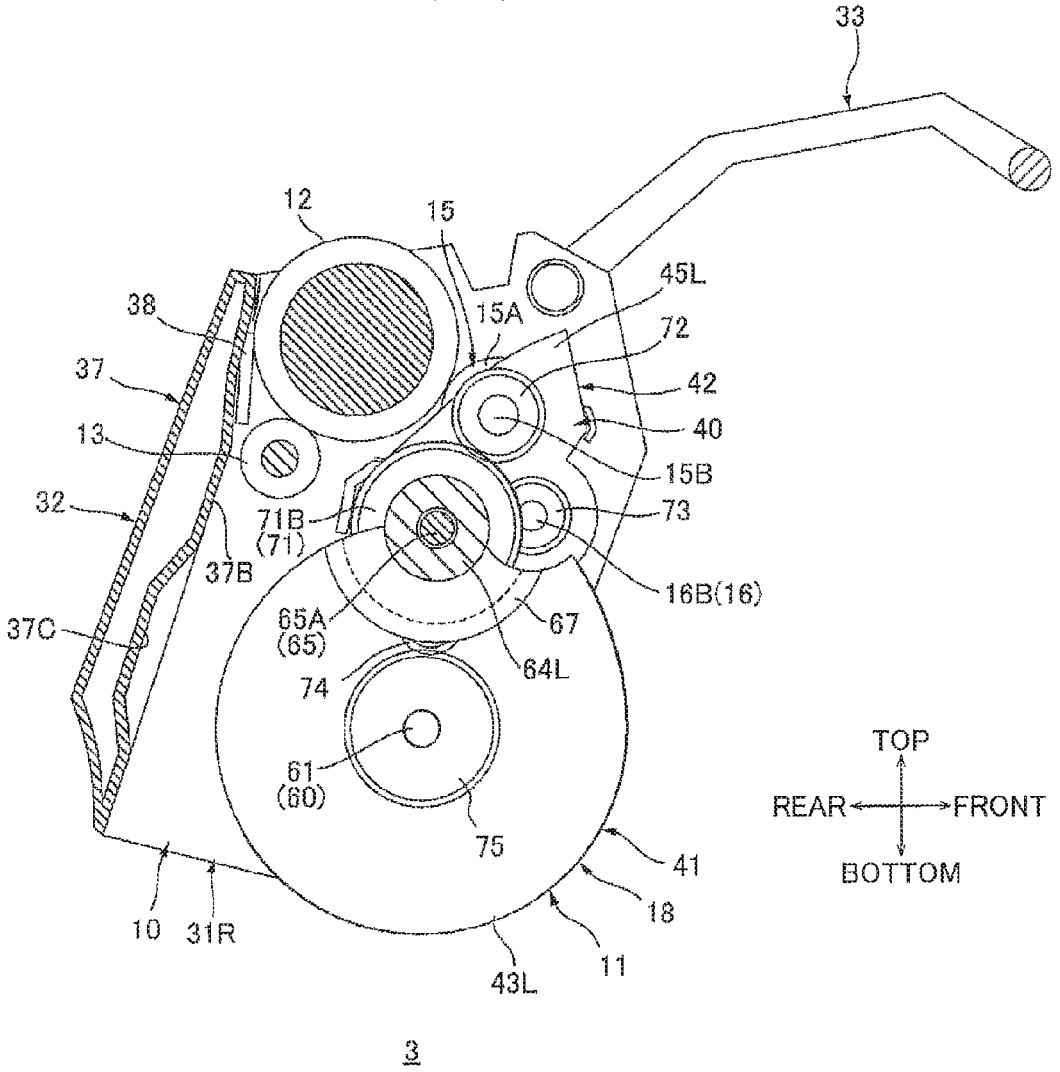
FIG. 11 is a cross-sectional view of the developing device taken along a line H-H in FIG. 3.

As shown in FIGS. 7A and 11, the two recessed parts 37C include a left recessed part 37C (see FIG. 11) positioned at a left end portion of the accommodating portion 37, and a right recessed part 37C (see FIG. 7A) positioned at a right end portion of the accommodating portion 37. The two recessed parts 37C are positioned downward of the charging roller 13. The two recessed parts 37C are recessed rearward from a front surface of the accommodating portion 37.

As shown in FIG. 2, the scraping blade 38 is positioned at a top end portion of the drum cleaner 32. The scraping blade 38 has a plate shape that is elongated both in the vertical direction and in the left-right direction. The scraping blade 38 is attached to a front surface of the opposing wall 37B on a lower edge of the opening 37A. A top end portion of the scraping blade 38 is positioned within the opening 37A and contacts the rear portion of the circumferential surface of the photosensitive drum 12.

As shown in FIGS. 2 and 3, the handle 33 is positioned at a top end portion of the drum unit 10. The handle 33 is pivotally movable between an upright position (indicated in dashed lines in FIG. 2) extending vertically upward, and an inclined position (indicated by solid lines in FIG. 2) inclined forward from the upright position. The handle 33 is constantly urged toward the upright position by two coil springs 39 (see also FIGS. 4A and 4B).

(2) Developing Unit

As shown in FIGS. 2 and 3, the developing unit 11 is positioned between the left side plate 31L and the right side plate 31R. The developing unit 11 is pivotally movable between a first position (see FIG. 7A) in which the developing roller 15 contacts the photosensitive drum 12, and a second position (see FIG. 7B) in which the developing roller 15 is separated from the photosensitive drum 12. The following description of the developing unit 11 will be based on the developing unit 11 being in its first position. Tension springs 30 (see FIG. 7B) constantly urge the developing unit 11 toward its second position. In addition to the toner chamber 18 described earlier, the developing unit 11 includes a developing chamber 42, a left support shaft 64L, and a right support shaft 64R.

(2-1) Developing Chamber

As shown in FIGS. 2 and 3, the developing chamber 42 is positioned at a top portion of the developing unit 11. The developing chamber 42 includes a first frame 40, the developing roller 15, the supply roller 16, and the blade 17, a second conveying member 65, a plurality of end seals 50, a pair of side seals 52 (see FIG. 6; also referred to as a left side seal 52L and a right side seal 52R, note that the left side seal 52L is not shown in the drawings), and a pair of shaft seals 51 (see FIG. 6).

(2-1-1) First Frame

The first frame 40 has a box shape with an upper-rear opening. The first frame 40 includes a first side wall 45R, a second side wall 45L, a bottom wall 46, a front wall 47, and a rear wall 48.

The first side wall 45R is positioned at a right end portion of the first frame 40. The first side wall 45R extends both in the vertical direction and in the front-rear direction. The first side wall 45R includes a toner supply part 55 having a supply opening 55A, and a right seal support part 49R.

Figure 5:
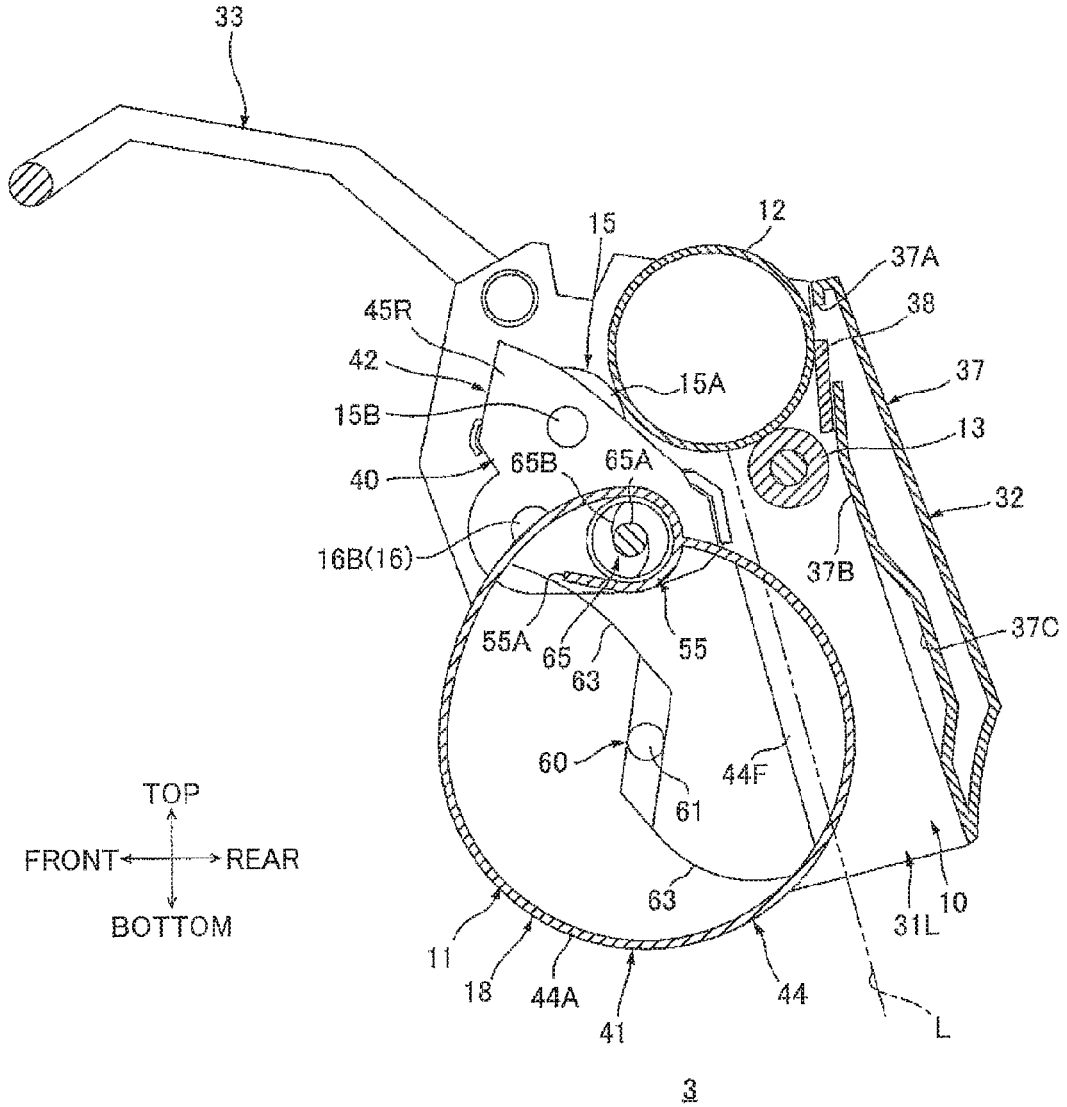
FIG. 5 is a cross-sectional view of the developing device taken along a line B-B in FIG. 3.

As shown in FIGS. 3 and 5, the toner supply part 55 is positioned on a right end portion of the first frame 40. The toner supply part 55 protrudes rightward from a lower-rear end portion of the first side wall 45R. The toner supply part 55 is positioned further rightward than the supply roller 16. The toner supply part 55 has a cylindrical shape whose right end is closed. A left end of the toner supply part 55 is in communication with a lower-rear portion of an internal space defined by the first frame 40.

The supply opening 55A is positioned at a front end portion of the toner supply part 55. In other words, the supply opening 55A is positioned forward of the second conveying member 65 and on a side the same as a side where the supply roller 16 is positioned relative to the second conveying member 65. The supply opening 55A is positioned further rightward than a right end face of a cover part 16A described later. The supply opening 55A is also positioned between the supply roller 16 and the second conveying member 65 when viewed in the left-right direction. The supply opening 55A is positioned further rightward than the supply roller 16. The supply opening 55A penetrates a front portion of a circumferential wall of the toner supply part 55 in the front-rear direction.

Figure 6:
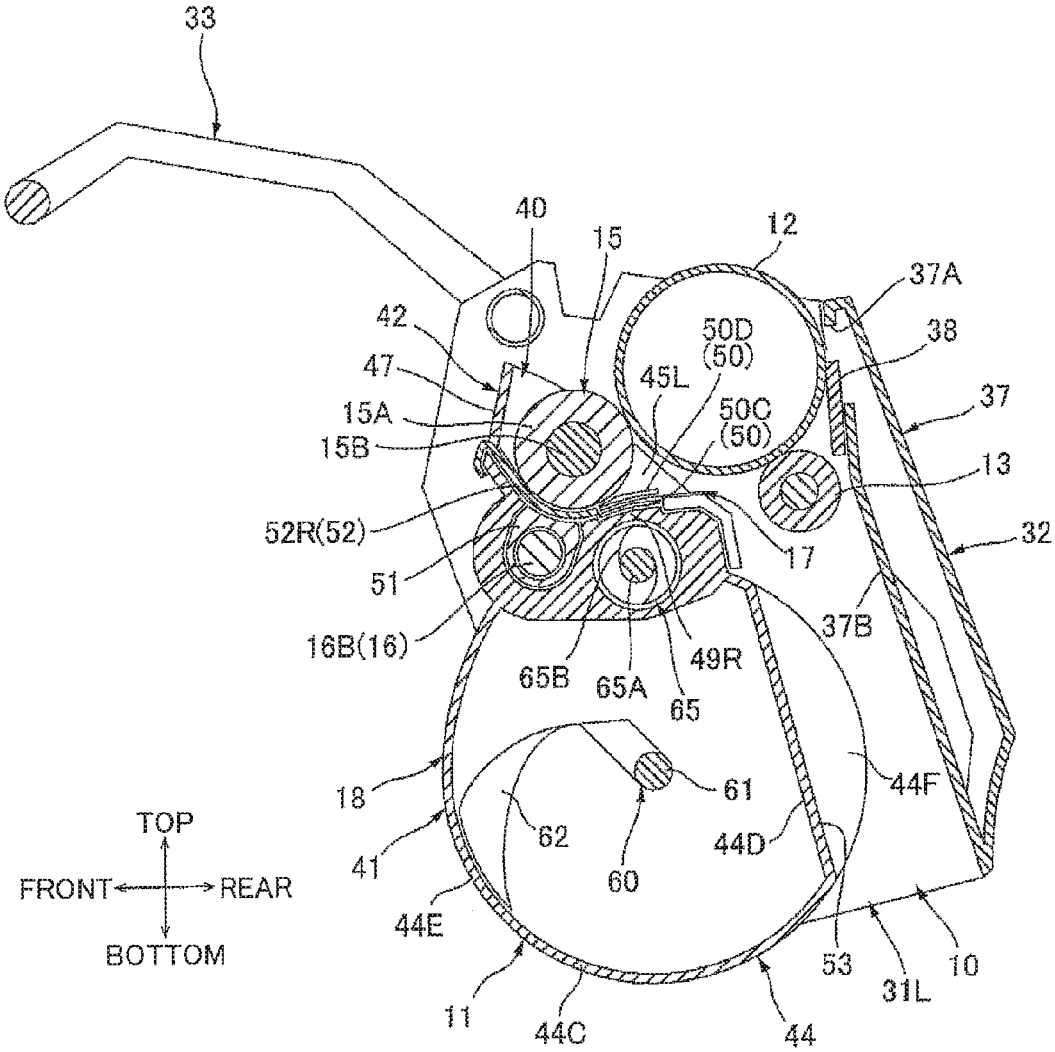
FIG. 6 is a cross-sectional view of the developing device taken along a line C-C in FIG. 3.

As shown in FIGS. 3 and 6, the right seal support part 49R is positioned between a right end portion of the second conveying member 65 and a right end portion of the developing roller 15. The right seal support part 49R protrudes leftward (inward) from a left surface (inner surface) of the first side wall 45R. The right seal support part 49R has a plate shape that is elongated in the left-right direction.

The second side wall 45L is positioned at a left end portion of the first frame 40. The second side wall 45L extends both in the vertical direction and in the front-rear direction. The second side wall 45L includes a toner discharge part 54 having a discharge opening 54A, and a left seal support part 49L.

Figure 8:
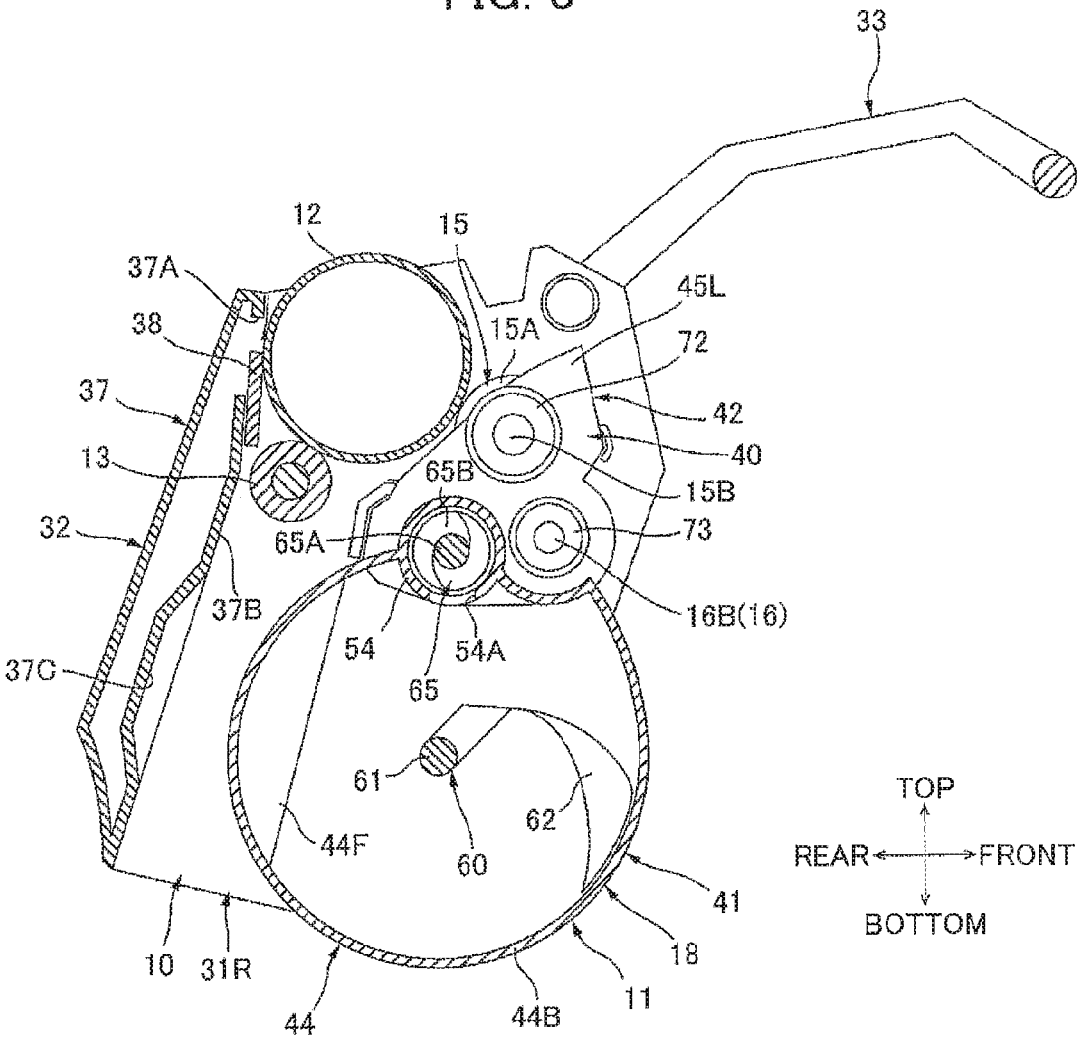
FIG. 8 is a cross-sectional view of the developing device taken along a line E-E in FIG. 3.

As shown in FIGS. 3 and 8, the toner discharge part 54 is positioned at a left end portion of the first frame 40. The toner discharge part 54 protrudes leftward from a lower-rear end portion of the second side wall 45L. The toner discharge part 54 is positioned further leftward than the supply roller 16. The toner discharge part 54 has a cylindrical shape whose left end is closed. A right end of the toner discharge part 54 is in communication with the lower-rear portion of the internal space defined by the first frame 40.

The discharge opening 54A is positioned at a bottom end portion of the toner discharge part 54. The discharge opening 54A is positioned further leftward than the supply roller 16. The discharge opening 54A is also positioned further leftward than the left end face of the cover part 16A. The discharge opening 54A penetrates a bottom portion of a circumferential wall of the toner discharge part 54 in the vertical direction.

As shown in FIG. 3, the left seal support part 49L is positioned between a left end portion of the second conveying member 65 and a left end portion of the developing roller 15. The left seal support part 49L protrudes rightward (inward) from a right surface (inner surface) of the second side wall 45L. The left seal support part 49L has a plate shape that is elongated in the left-right direction.

As shown in FIGS. 2 and 3, the bottom wall 46 is positioned at a bottom end portion of the first frame 40. The bottom wall 46 is positioned between the second side wall 45L and the first side wall 45R. The bottom wall 46 extends both in the left-right direction and in the front-rear direction. A left edge of the bottom wall 46 is connected to a bottom edge of the second side wall 45L, while a right edge of the bottom wall 46 is connected to a bottom edge of the first side wall 45R. The bottom wall 46 configures a partitioning wall together with the circumferential wall of the toner supply part 55 and the circumferential wall of the toner discharge part 54. The bottom wall 46 partitions the toner chamber 18 and the developing chamber 42.

The front wall 47 is positioned at a front end portion of the first frame 40. The front wall 47 extends upward from a front edge of the bottom wall 46. A left edge of the front wall 47 is connected to a front edge of the second side wall 45L, while a right edge of the front wall 47 is connected to a front edge of the first side wall 45R.

The rear wall 48 is positioned at a rear end portion of the first frame 40. The rear wall 48 extends upward from a rear edge of the bottom wall 46. A left edge of the rear wall 48 is connected to a rear edge of the second side wall 45L, while a right edge of the rear wall 48 is connected to a rear edge of the first side wall 45R.

(2-1-2) Developing Roller

As shown in FIGS. 2 and 3, the developing roller 15 is accommodated in an upper portion of the internal space defined by the first frame 40. The developing roller 15 includes a cover part 15A as an example of a developing cover part, and a shaft 15B as an example of a developing shaft.

The cover part 15A constitutes an outer circumferential portion of the developing roller 15 in a radial direction of the developing roller 15. The cover part 15A covers the shaft 15B. The cover part 15A has a cylindrical shape and extends in the left-right direction.

The shaft 15B constitutes a center portion of the developing roller 15 in the radial direction of the developing roller 15. The shaft 15B has a columnar shape and extends in the left-right direction. The shaft 15B is inserted into an interior of the cover part 15A such that an outer circumferential surface of the shaft 15B is in contact with an inner circumferential surface of the cover part 15A. A left end portion of the shaft 15B protrudes further leftward than a left end face of the cover part 15A and is rotatably supported at the second side wall 45L. Similarly, a right end portion of the shaft 15B protrudes further rightward than a right end face of the cover part 15A and is rotatably supported at the first side wall 45R.

(2-1-3) Supply Roller

The supply roller 16 is accommodated in a lower-front portion of the internal space defined by the first frame 40. The supply roller 16 includes the cover part 16A as an example of a supply cover part, and a shaft 16B as an example of a supply shaft.

The cover part 16A constitutes an outer circumferential portion of the supply roller 16 in a radial direction of the supply roller 16. The cover part 16A has a cylindrical shape and extends in the left-right direction. The cover part 16A is in contact with a lower-front portion of a circumferential surface of the cover part 15A.

The shaft 16B constitutes a center portion of the supply roller 16 in the radial direction of the supply roller 16. The shaft 16B has a columnar shape and extends in the left-right direction. The shaft 16B is inserted into an interior of the cover part 16A such that an outer circumferential surface of the shaft 16B is in contact with an inner circumferential surface of the cover part 16A. A left end portion of the shaft 16B protrudes further leftward than a left end face of the cover part 16A and is rotatably supported at the second side wall 45L. Similarly, a right end portion of the shaft 16B protrudes further rightward than a right end face of the cover part 16A and is rotatably supported at the first side wall 45R.

(2-1-4) Blade

The blade 17 includes a support plate 17A, and a contact part 17B.

The support plate 17A has a plate shape that is elongated both in the front-rear direction and in the left-right direction. The support plate 17A is formed of metal, for example. A rear end portion of the support plate 17A is supported at a top end portion of the rear wall 48.

The contact part 17B is supported on a top surface of the support plate 17A at a front end portion thereof. The contact part 17B has a plate shape that is elongated in the left-right direction. The contact part 17B is formed of rubber, for example. The contact part 17B is in contact with a bottom portion of an outer circumferential surface of the cover part 15A.

(2-1-5) Second Conveying Member

The second conveying member 65 is accommodated in the lower-rear portion of the internal space defined by the first frame 40. The second conveying member 65 is positioned rearward of the supply roller 16. The second conveying member 65 is juxtaposed with the supply roller 16 in the front-rear direction (horizontally). The second conveying member 65 extends in the left-right direction. The second conveying member 65 is an auger screw. The second conveying member 65 includes a shaft 65A, and a helical blade 65B.

The shaft 65A has a columnar shape that extends in the left-right direction. A left end portion of the shaft 65A is rotatably supported at a left wall of the toner discharge part 54 and the left support shaft 64L, while a right end portion of the shaft 65A is rotatably supported at a right wall of the toner supply part 55 and the right support shaft 64R.

The helical blade 65B protrudes radially outward from a circumferential surface of the shaft 65A. The helical blade 65B has a helical shape, with its axis extending in the left-right direction. The helical blade 65B is positioned between the right wall of the toner supply part 55 and the left wall of the toner discharge part 54. A right end portion of the helical blade 65B confronts the supply opening 55A, while a left end portion of the helical blade 65B confronts the discharge opening 54A.

(2-1-6) Seals and Related Structures in Developing Chamber

As shown in FIGS. 3 and 6, the plurality of end seals 50 includes an end seal 50A that seals a gap between a left end of the support plate 17A and the left seal support part 49L, an end seal 50B that seals a gap between the left end of the support plate 17A and a left end portion of the cover part 15A, an end seal 50C that seals a gap between a right end of the support plate 17A and the right seal support part 49R, and an end seal 50D that seals a gap between the right end of the support plate 17A and a right end portion of the cover part 15A. The end seals 50 each have a plate shape that extends in the left-right direction. The end seals 50 are formed of sponge, for example.

The pair of side seals 52 is positioned forward of the end seals 50. The side seals 52 each have a plate shape that is elongated in the front-rear direction. The side seals 52 contact a bottom portion of the outer circumferential surface of the cover part 15A at left and right end portions, respectively. The right side seal 52R as an example of a first seal contacts the right end portion of the cover part 15A and is positioned further leftward (inward) than the supply opening 55A. The left side seal 52L as an example of a second seal contacts the left end portion of the cover part 15A and is positioned further rightward (inward) than the discharge opening 54A.

The pair of shaft seals 51 is positioned below the pair of side seals 52, respectively. The shaft seals 51 each have a cylindrical shape that extends in the left-right direction. A top surface of each shaft seal 51 contacts a bottom surface of the corresponding side seal 52. Left and right end portions of the shaft 16B are respectively inserted into the shaft seals 51 such that the outer circumferential surface of the shaft 16B contacts inner circumferential surfaces of the shaft seals 51.

(2-2) Toner Chamber

As shown in FIGS. 2 and 3, the toner chamber 18 is positioned beneath the developing chamber 42. The toner chamber 18 includes a second frame 41, and a first conveying member 60.

(2-2-1) Second Frame

The second frame 41 has a cylindrical shape that extends in the left-right direction. The second frame 41 has a left-right dimension greater than that of the first frame 40.

Together with the first frame 40, the second frame 41 configures a casing. The second frame 41 includes a left side wall 43L, a right side wall 43R, and a circumferential wall 44 having a recessed part 53.

As shown in FIGS. 3 and 11, the left side wall 43L is positioned at a left end portion of the toner chamber 18. The left side wall 43L is positioned further leftward than the second side wall 45L of the first frame 40. The left side wall 43L extends both in the vertical direction and in the front-rear direction. The left side wall 43L has a circular shape in a side view.

Figure 7B:
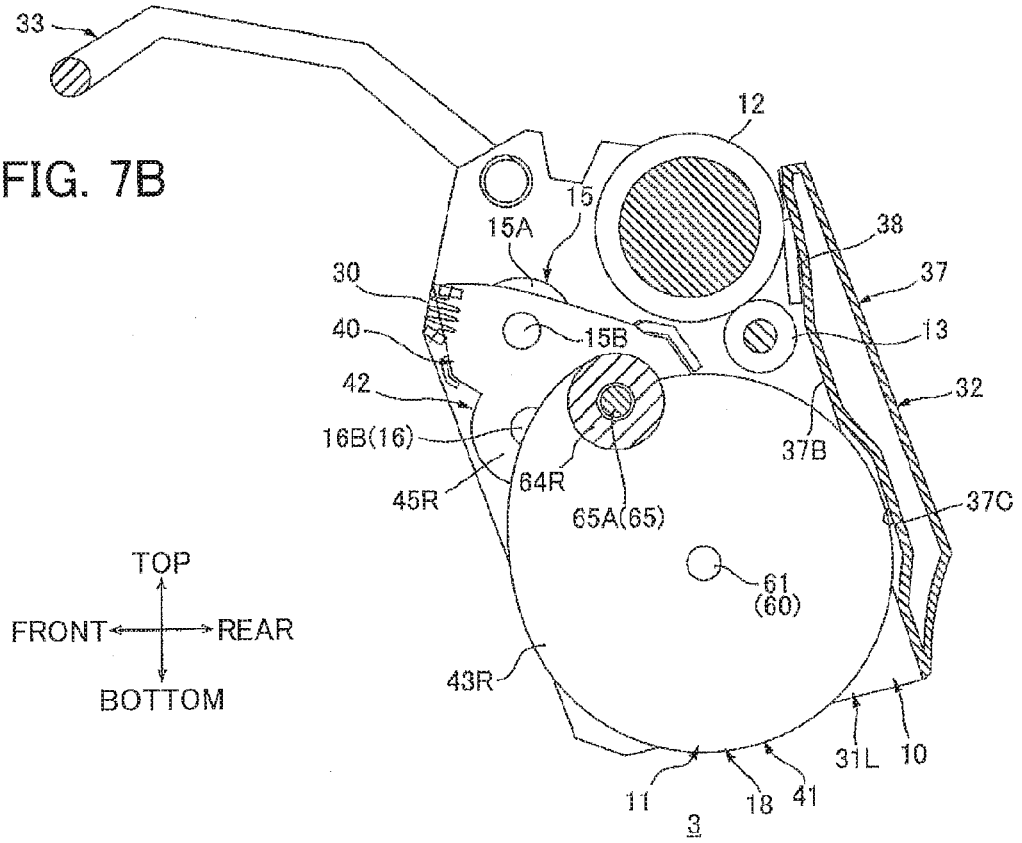
FIG. 7B is a cross-sectional view of the developing device taken along the line D-D in FIG. 3 and showing a second position of a developing unit.

As shown in FIGS. 3, 7A and 7B, the right side wall 43R is positioned at a right end portion of the toner chamber 18. The right side wall 43R is positioned further rightward than the first side wall 45R of the first frame 40. The right side wall 43R extends both in the vertical direction and in the front-rear direction. The right side wall 43R has a circular shape in a side view.

As shown in FIGS. 2 and 3, the circumferential wall 44 is positioned between the left side wall 43L and the right side wall 43R. The circumferential wall 44 has a cylindrical shape. A left edge of the circumferential wall 44 is connected to an edge of the left side wall 43L, while a right edge of the circumferential wall 44 is connected to an edge of the right side wall 43R. The circumferential wall 44 includes a first circumferential wall 44A as an example of a first accommodating wall, a second circumferential wall 44B, and a third circumferential wall 44C.

The recessed part 53 is positioned at an intermediate portion of the circumferential wall 44 in the left-right direction. The recessed part 53 is recessed forward from a rear end portion of the circumferential wall 44. The recessed part 53 has a left-right dimension approximately equal to a left-right dimension of the developing chamber 42. Further, the left-right dimension of the recessed part 53 is greater than a left-right dimension of the cover part 15A and smaller than a left-right dimension of the photosensitive drum 12.

As shown in FIGS. 3 and 5, the first circumferential wall 44A constitutes a right end portion of the circumferential wall 44. The first circumferential wall 44A is positioned further rightward than the developing chamber 42. The first circumferential wall 44A is also positioned further rightward than the recessed part 53. The first circumferential wall 44A has an arcuate shape that extends in a circumferential direction of the toner chamber 18. Hence, an inner surface of the first circumferential wall 44A has an arcuate shape. An upper edge of the first circumferential wall 44A is connected to the toner supply part 55. Consequently, the supply opening 55A provides communication between the toner chamber 18 and the toner supply part 55 of the developing chamber 42.

As shown in FIGS. 3 and 8, the second circumferential wall 44B constitutes a left end portion of the circumferential wall 44. The second circumferential wall 44B is positioned further leftward than the developing chamber 42. The second circumferential wall 44B is also positioned further leftward than the recessed part 53. The second circumferential wall 44B has an arcuate shape that extends in the circumferential direction of the toner chamber 18. An upper edge of the second circumferential wall 44B is connected to the toner discharge part 54. Consequently, the discharge opening 54A provides communication between the toner chamber 18 and the toner discharge part 54 of the developing chamber 42.

As shown in FIGS. 2 and 3, the third circumferential wall 44C is positioned between the first circumferential wall 44A and the second circumferential wall 44B. Hence, the third circumferential wall 44C is positioned closer to the discharge opening 54A in the left-right direction than the first circumferential wall 44A to the discharge opening 54A. The third circumferential wall 44C is positioned below the developing chamber 42. The third circumferential wall 44C includes a flat wall 44D as an example of a second accommodating wall, an arc wall 44E, and a plurality of (two) connecting walls 44F.

The flat wall 44D constitutes a rear wall of the third circumferential wall 44C. The flat wall 44D forms a bottom wall in the recessed part 53. The flat wall 44D extends linearly in a direction from lower rear to upper front. Hence, an inner surface of the flat wall 44D extends linearly. A top edge of the flat wall 44D is connected to a rear edge on a bottom end portion of the developing chamber 42.

The arc wall 44E constitutes bottom and front circumferential walls of the third circumferential wall 44C. The arc wall 44E has an arcuate shape that extends in the circumferential direction of the toner chamber 18. A rear edge of the arc wall 44E is connected to a bottom edge of the flat wall 44D, while a top edge of the arc wall 44E is connected to a lower-front edge of the developing chamber 42.

As shown in FIGS. 5 and 8, the two connecting walls 44F include a left connecting wall 44F (see FIG. 8) positioned at a left end portion of the third circumferential wall 44C, and a right connecting wall 44F (see FIG. 5) positioned at a right end portion of the third circumferential wall 44C. The left connecting wall 44F extends rearward from a left edge of the flat wall 44D and is connected to a right edge of the second circumferential wall 44B. The left connecting wall 44F constitutes a left wall of the recessed part 53. The right connecting wall 44F extends rearward from a right edge of the flat wall 44D and is connected to a left edge of the first circumferential wall 44A. The right connecting wall 44F constitutes a right wall of the recessed part 53.

(2-2-2) First Conveying Member

As shown in FIGS. 2 and 3, the first conveying member 60 is positioned inside the second frame 41. The first conveying member 60 includes an agitator shaft 61 as an example of a shaft, a plurality of (two) first blades 63, and a plurality of second blades 62.

The agitator shaft 61 is positioned in a radial center portion of the second frame 41. The agitator shaft 61 has a columnar shape that extends in the left-right direction. A left end portion of the agitator shaft 61 is rotatably supported at the left side wall 43L, while a right end portion of the agitator shaft 61 is rotatably supported at the right side wall 43R. With this configuration, the first conveying member 60 is rotatable about a fourth axis A4 positioned downward of the third axis A3.

As shown in FIG. 5, the first blades 63 are positioned at a right end portion of the first conveying member 60. The first blades 63 are arranged at the same left-right position as the supply opening 55A. The first blades 63 are positioned inside the first circumferential wall 44A. The first blades 63 have a plate shape and extend from the agitator shaft 61 toward an inner surface of the first circumferential wall 44A. The two first blades 63 are disposed on opposite sides of the agitator shaft 61 in a radial direction of the toner chamber 18. The first blades 63 are formed of a flexible resin film.

As shown in FIG. 2, the plurality of second blades 62 is positioned further leftward than the first blades 63. More specifically, the plurality of second blades 62 is positioned closer to the discharge opening 54A in the left-right direction than the first blades 63 to the discharge opening 54A. The second blades 62 are arrayed in the left-right direction. The second blades 62 are positioned inside the third circumferential wall 44C and the second circumferential wall 44B. The second blades 62 have a plate shape and extend from the agitator shaft 61 toward an inner surface of the circumferential wall 44. The second blades 62 are formed of the same flexible resin film as the first blades 63, but are thinner than the first blades 63. Hence, the plurality of second blades 62 has flexibility higher than that of the first blades 63.

Distal edges of the second blades 62 are slanted from right to left so as to approach the agitator shaft 61. In other words, a free length of the second blades 62 on their sides nearest the discharge opening 54A is shorter than a free length of the second blades 62 on their sides nearest the supply opening 55A. This configuration serves to convey toner from left to right as the second blades 62 rotate.

(2-3) Support Shaft

As shown in FIG. 3, the left support shaft 64L is positioned leftward of and spaced apart from the toner discharge part 54. The left support shaft 64L has a columnar shape that is elongated in the left-right direction. The left support shaft 64L is rotatably fitted into the hole 36 formed in the left side plate 31L. The left support shaft 64L includes an extension part 67, and a plurality (two) of leg parts 68.

As shown in FIGS. 3 and 11, the extension part 67 extends downward at a right end portion of the left support shaft 64L. The extension part 67 is plate-shaped, and has a sector shape in a side view.

Figure 9:
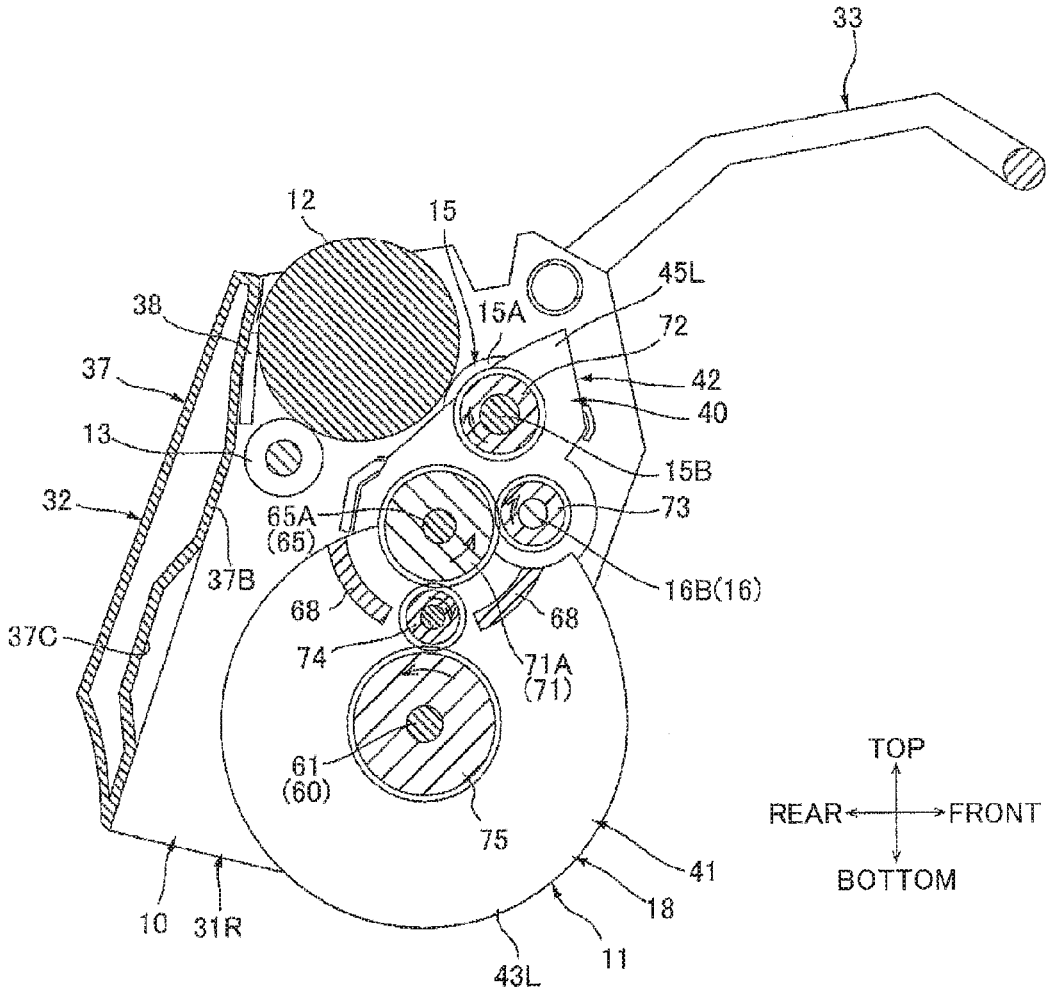
FIG. 9 is a cross-sectional view of the developing device taken along a line F-F in FIG. 3.

As shown in FIGS. 3 and 9, the two leg parts 68 are arranged spaced apart from each other in the front-rear direction. The leg parts 68 are positioned between the extension part 67 and the left side wall 43L. A left edges of the leg parts 68 are connected to a bottom edge of the extension part 67, while right edges of the leg parts 68 are connected to a left surface of the left side wall 43L. The leg parts 68 extend along the bottom edge of the extension part 67. The leg parts 68 have a plate shape.

The right support shaft 64R extends rightward from a right wall of the toner supply part 55. The right support shaft 64R has a columnar shape. The right support shaft 64R is rotatably fitted into the hole 36 formed in the right side plate 31R.

By rotatably fitting the left support shaft 64L into the hole 36 of the left side plate 31L and the right support shaft 64R into the hole 36 of the right side plate 31R, the developing unit 11 is capable of pivotally moving about a rotational axis of the second conveying member 65.

(2-4) Drive System of Developing Unit

Figure 10:
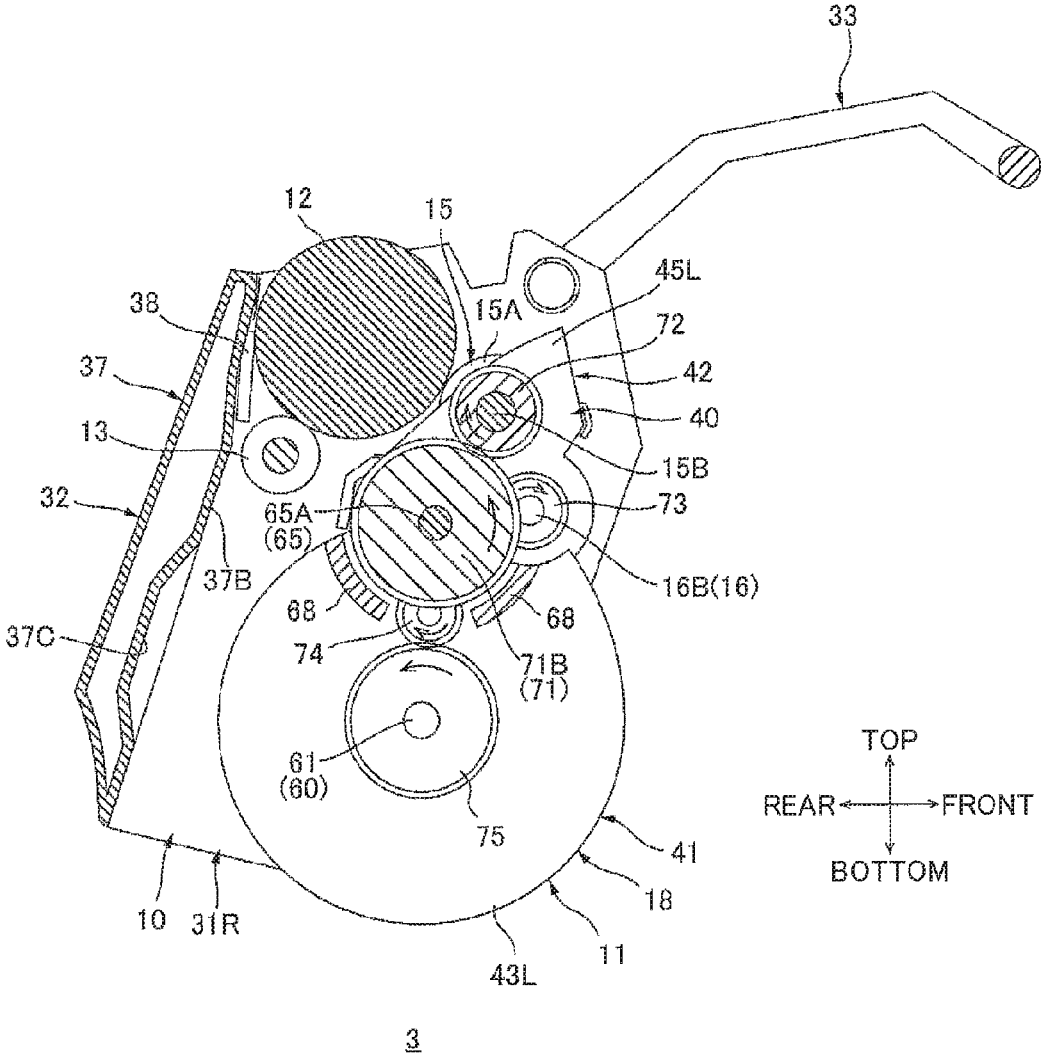
FIG. 10 is a cross-sectional view of the developing device taken along a line G-G in FIG. 3.

As shown in FIGS. 4B, 9, and 10, the developing unit 11 further includes a coupling 70, a two-stage gear 71, a developing gear 72, a supply gear 73, an idle gear 74, and an agitator gear 75.

As shown in FIGS. 3 and 4B, the coupling 70 is positioned rightward of the right support shaft 64R. The coupling 70 is fixed to a right end of the shaft 65A of the second conveying member 65. The coupling 70 can rotate together with the shaft 65A.

As shown in FIG. 3, the two-stage gear 71 is positioned between the toner discharge part 54 and the left support shaft 64L. The two-stage gear 71 is fixed to a left end portion of the shaft 65A of the second conveying member 65. The two-stage gear 71 can rotate together with the shaft 65A. The two-stage gear 71 includes a small-diameter gear 71A, and a large-diameter gear 71B.

As shown in FIGS. 3 and 9, the small-diameter gear 71A has a disc shape. The small-diameter gear 71A has gear teeth provided around its entire circumferential surface.

As shown in FIGS. 3 and 10, the large-diameter gear 71B is integrally overlapped with a left surface of the small-diameter gear 71A. The large-diameter gear 71B has a disc shape with a diameter larger than that of the small-diameter gear 71A. The large-diameter gear 71B has gear teeth provided around its entire circumferential surface. The large-diameter gear 71B is positioned coaxially with the small-diameter gear 71A.

The developing gear 72 is positioned leftward of the second side wall 45L. The developing gear 72 is fixed to a left end portion of the shaft 15B. The developing gear 72 has a columnar shape that extends in the left-right direction. The developing gear 72 has gear teeth provided around its entire circumferential surface. The developing gear 72 can rotate together with the shaft 15B. The developing gear 72 is meshedly engaged with a top end portion of the large-diameter gear 71B.

As shown in FIG. 9, the supply gear 73 is positioned leftward of the second side wall 45L. The supply gear 73 is fixed to a left end portion of the shaft 16B. The supply gear 73 has a disc shape. The supply gear 73 has gear teeth provided around its entire circumferential surface. The supply gear 73 can rotate together with the shaft 16B. The supply gear 73 is meshedly engaged with a front end portion of the small-diameter gear 71A.

As shown in FIGS. 3 and 9, the idle gear 74 is positioned between the left side wall 43L and the extension part 67 in the left-right direction. Further, the idle gear 74 is positioned between the two leg parts 68 in the front-rear direction. The idle gear 74 is rotatably supported at a left surface of the left side wall 43L. The idle gear 74 has a disc shape. The idle gear 74 has gear teeth provided around its entire circumferential surface. The idle gear 74 is meshedly engaged with a bottom end portion of the small-diameter gear 71A.

The agitator gear 75 is positioned leftward of the left side wall 43L. The agitator gear 75 is fixed to a left end portion of the agitator shaft 61. The agitator gear 75 has a disc shape. The agitator gear 75 has gear teeth provided around its entire circumferential surface. The agitator gear 75 can rotate together with the agitator shaft 61. The agitator gear 75 is meshedly engaged with a bottom end portion of the idle gear 74.

3. Belt Unit

As shown in FIG. 1, the belt unit 5 includes the pivot member 82.

The pivot member 82 is positioned at a rear end portion of the belt unit 5. The pivot member 82 is fixed to a rear end portion of the belt unit 5 and is pivotally movably supported at the main casing 2 at a position outward of the fixing unit 7 in the left-right direction. The pivot member 82 includes pivot shafts 101, arms 102, and a support shaft 103.

One of the pivot shafts 101 is positioned leftward of the fixing unit 7, while the other of the pivot shafts 101 is positioned rightward of the fixing unit 7. The pivot shafts 101 overlap the fixing unit 7 when viewed in the left-right direction. The left pivot shaft 101 is pivotally movably supported at the main casing 2 at a position leftward of the fixing unit 7, while the right pivot shaft 101 is pivotally movably supported at the main casing 2 at a position rightward of the fixing unit 7. The pivot shafts 101 have a cylindrical shape that extends in the left-right direction.

The arms 102 extend diagonally downward and forward (radially outward) from circumferential surfaces of the corresponding pivot shafts 101. The arms 102 have a plate shape.

The support shaft 103 extends through the rear end portion of the belt unit 5 in the left-right direction. A left end portion of the support shaft 103 is connected to a lower-front end portion of the left arm 102, while a right end portion of the support shaft 103 is connected to a lower-front end portion of the right arm 102.

The reading unit 26 is connected to the pivot shafts 101 of the pivot member 82 through connecting parts (not shown). Accordingly, the cover 8, the belt unit 5, and the reading unit 26 are pivotally movable together about the axis of the pivot shafts 101 of the pivot member 82.

4. Operations of Developing Device (1) Pivotal Movement of Developing Unit

Next, operations for pivotally moving the developing unit 11 between the first position and the second position will be described while referring to FIGS. 3, 7A, and 7B.

When the developing devices 3 have been mounted in the main casing 2, couplings 81 (see FIG. 3) provided in the main casing 2 are fitted into the couplings 70 of the corresponding developing units 11 so as to be incapable of rotating relative to the couplings 70.

While the couplings 81 are not rotated in this state, the developing units 11 are urged toward the second position by the tension springs 30, as illustrated in FIG. 7B.

At this time, a rear end portion of the first circumferential wall 44A of the toner chamber 18 in each developing unit 11 is positioned inside the right recessed part 37C formed in the drum cleaner 32. Further, a rear end portion of the second circumferential wall 44B of the toner chamber 18 in the developing unit 11 is positioned inside the left recessed parts 37C formed in the drum cleaner 32.

When the image-forming operation described above is executed, each coupling 81 rotates, and the coupling 70 and the second conveying member 65 of the corresponding developing unit 11 rotate in response to the rotation of the coupling 81. That is, the coupling 70 transmits a drive force from the coupling 81 to the second conveying member 65.

In this way, the drive force of the coupling 81 is inputted into the corresponding developing unit 11.

Then, torque of the coupling 81 causes the developing unit 11 to move to the first position against the urging force of the tension springs 30, as shown in FIG. 7A.

(2) Toner Circulation

When the drive force of the coupling 81 is inputted into the developing unit 11, the second conveying member 65 rotates, and the two-stage gear 71 rotates together with the second conveying member 65, as shown in FIGS. 9 and 10.

Accordingly, the developing gear 72, the supply gear 73, and the idle gear 74 rotate in a direction opposite a rotational direction of the two-stage gear 71. Consequently, the developing roller 15 and the supply roller 16 rotate in a direction opposite a rotational direction of the second conveying member 65.

Further, upon rotation of the idle gear 74, the agitator gear 75 rotates in a direction opposite a rotational direction of the idle gear 74. Consequently, the first conveying member 60 rotates in a direction opposite the rotational direction of the developing roller 15 and the supply roller 16.

Upon rotation of the first conveying member 60, the rotating second blades 62 of the first conveying member 60 convey the toner accommodated in the toner chamber 18 from left to right, as shown in FIG. 3.

Next, the rotating first blades 63 of the first conveying member 60 supply the toner accommodated in the toner chamber 18 into the toner supply part 55 through the supply opening 55A, as shown in FIG. 5. In other words, the first conveying member 60 supplies the toner accommodated in the toner chamber 18 into the toner supply part 55 of the developing chamber 42 through the supply opening 55A.

The toner supplied into the toner supply part 55 is then conveyed from right to left in a lower-rear portion of the developing chamber 42 by the rotating second conveying member 65, as illustrated in FIG. 3.

At this time, a rotating speed of the second conveying member 65 is adjusted so that the amount of toner in the lower-rear portion of the developing chamber 42 is uniform across the left-right direction.

The supply roller 16 subsequently supplies the toner in the lower-rear portion of the developing chamber 42 onto the developing roller 15.

Here, excess toner in the lower-rear portion of the developing chamber 42 that is not supplied onto the developing roller 15 is discharged back into the toner chamber 18 through the discharge opening 54A. In other words, the second conveying member 65 conveys the toner from the supply opening 55A toward the discharge opening 54A.

In this way, the toner accommodated in the toner chamber 18 is circulated between the lower-rear portion of the developing chamber 42 and the toner chamber 18.

5. Operations for Mounting Developing Devices in and Removing Developing Devices from Main Casing Next, operations for mounting the developing devices 3 in the main casing 2 and removing the developing devices 3 from the main casing 2 will be described while referring to FIGS. 1 and 12.

(1) Mounted State of Developing Device

As described above, once the developing devices 3 are mounted in the main casing 2 and the image-forming operation is executed, the developing units 11 of the developing devices 3 are in their first position.

At this time, the flat wall 44D of the third circumferential wall 44C of each toner chamber 18 is substantially parallel to the opposing wall 37B of the corresponding drum cleaner 32 while remaining separated therefrom, as illustrated in FIG. 2.

As illustrated in FIG. 1, laser beams L emitted from the exposure device 4 pass through the gaps between the flat walls 44D and the corresponding opposing walls 37B and are incident on the corresponding photosensitive drums 12. In other words, when the developing unit 11 of the developing device 3 is in its first position, the toner chamber 18 is retracted forward from a path of the laser beam L, and the flat wall 44D extends alongside the path of the laser beam L. Further, as illustrated in FIG. 5, the supply opening 55A is positioned opposite the path of the laser beam L (indicated in a dashed line in FIG. 5) with respect to the second conveying member 65 when viewed in the left-right direction.

Further, a front end portion of the arc wall 44E of the third circumferential wall 44C of the toner chamber 18 in one developing device 3 confronts a bottom end portion of the drum cleaner 32 in another developing device 3 immediately forward of the one developing device 3, as illustrated in FIG. 1.

Thus, when the developing unit 11 is in the first position, the toner chamber 18 of one developing device 3 is disposed at a position that interferes with the drum cleaner 32 of another developing device 3 immediately forward of the one developing device 3, thereby restricting the one developing device 3 from being removed from the main casing 2.

(2) Removing Developing Device

To remove any of the developing devices 3 from the main casing 2, a user lifts the cover 8 of the main casing 2 upward.

At this time, the cover 8 is pivotally moved together with the belt unit 5 and the reading unit 26 about the axis of the pivot shafts 101 of the pivot member 82 to be placed in the open position shown in FIG. 12. This operation exposes the opening 2A formed in the main casing 2 to an outside.

In association with the movement of the cover 8 to the open position, the couplings 81 (see FIG. 3) are retracted rightward from the couplings 70 of the corresponding developing units 11.

As a result, each developing unit 11 moves to the second position shown in FIG. 7B through the urging force of the tension springs 30.

Consequently, the arc wall 44E of the third circumferential wall 44C of the toner chamber 18 advances into the path of the laser beam L emitted from the exposure device 4, thereby blocking the path of the laser beam L to the photosensitive drum 12.

Next, the user grips the handle 33 and pulls the developing device 3 upward from the main casing 2.

Through this operation, the developing device 3 separates from the main casing 2, as indicated in dashed lines in FIG. 12.

(3) Mounting Developing Device

To mount any of the developing devices 3 in the main casing 2, the user first places the cover 8 in the open position and then inserts the developing device 3 into the main casing 2.

Through this operation, the developing device 3 is mounted in the main casing 2, as indicated in solid lines in FIG. 12. Next, the user moves the cover 8 from the open position to the closed position. In association with the movement of the cover 8 to the closed position, the couplings 81 (see FIG. 3) advance leftward to be fitted into the couplings 70 of the corresponding developing units 11.

6. Operational Advantages (1) According to the developing device 3 shown in FIG. 3, the toner accommodated in the toner chamber 18 is supplied into the supply opening 55A. The toner supplied into the supply opening 55A is conveyed by the second conveying member 65 and subsequently discharged back into the toner chamber 18 through the discharge opening 54A.

At this time, the amount of toner in the developing chamber 42 increases near the supply opening 55A due to toner being supplied from the toner chamber 18 and decreases near the discharge opening 54A due to toner being discharged back into the toner chamber 18. The amount of toner in the developing chamber 42 is kept uniform between the supply opening 55A and the discharge opening 54A by supporting toner with the bottom wall 46 and conveying toner with the second conveying member 65.

In other words, by arranging the supply opening 55A and the discharge opening 54A outward of the supply roller 16 in the left-right direction, the amount of toner in the developing chamber 42 can be kept uniform in an area in which the supply roller 16 is disposed.

Thus, the supply roller 16 can supply toner to the photosensitive drum 12 that is uniform in the left-right direction.

(2) According to the developing device 3 shown in FIG. 3, the supply opening 55A and the discharge opening 54A are arranged outward of the cover part 16A of the supply roller 16 in the left-right direction.

This arrangement reliably ensures a more uniform amount of toner in the developing chamber 42 in an area in which the cover part 16A is disposed.

(3) According to the developing device 3, as shown in FIG. 3, the second conveying member 65 of the developing device 3 is configured of an auger screw.

The second conveying member 65 of this configuration can more reliably convey toner within the developing chamber 42, thereby more reliably ensuring a uniform amount of toner in the developing chamber 42.

(4) According to the developing device 3, as shown in FIGS. 3 and 6, the side seal 52 is provided for contacting the end portion of the cover part 15A at a position inward of the supply opening 55A in the left-right direction.

Accordingly, toner accommodated in the toner chamber 18 can be supplied into the supply opening 55A by utilizing a space outward of the side seal 52 in the left-right direction.

(5) According to the developing device 3, as shown in FIG. 2, the second conveying member 65 is juxtaposed with the supply roller 16 in a horizontal direction.

Therefore, the second conveying member 65 can supply toner to the supply roller 16 simply by conveying the toner in the left-right direction. With this configuration, only the rotation of the supply roller 16 is used to supply toner from the developing chamber 42 onto the developing roller 15, while gravity is not required.

Accordingly, this configuration can prevent an excessive amount of toner from being supplied to the developing roller 15.

(6) According to the developing device 3, as shown in FIG. 3, the first conveying member 60 includes the first blades 63 arranged at a position coincident with the supply opening 55A in the left-right direction, and the second blades 62 positioned closer to the discharge opening 54A than the first blades 63 to the discharge opening 54A in the left-right direction. The second blades 62 have flexibility greater than the first blades 63.

Accordingly, the first blades 63 can reliably supply toner from the toner chamber 18 into the supply opening 55A.

Further, the second blades 62, which have a relatively high flexibility, can convey toner from left to right in the toner chamber 18 while bending.

(7) According to the developing device 3, the second blades 62 are formed of film that is thinner than that of the first blades 63.

Accordingly, a simple construction is used to ensure the flexibility of the second blades 62.

(8) According to the developing device 3, as shown in FIG. 5, the first conveying member 60 is provided with a plurality (two) of first blades 63.

Accordingly, this configuration can more reliably supply toner in the toner chamber 18 into the supply opening 55A.

(9) According to the developing device 3, as shown in FIGS. 2 and 5, the second frame 41 includes the first circumferential wall 44A that has an inner surface formed in an arcuate shape and accommodates the first blades 63, and the third circumferential wall 44C that is positioned leftward of the first circumferential wall 44A, accommodates the second blades 62, and has the flat wall 44D extending linearly.

Hence, the third circumferential wall 44C can be provided with the flat wall 44D by making use of the flexibility of the second blades 62.

Further, the first blades 63 can rotate smoothly along the arcuate shape of the first circumferential wall 44A, thereby smoothly supplying toner accommodated in the toner chamber 18 into the supply opening 55A.

(10) According to the developing device 3, as shown in FIG. 5, the supply opening 55A is positioned between the supply roller 16 and the second conveying member 65 as viewed in the left-right direction.

Accordingly, toner in the toner chamber 18 can be supplied into the supply opening 55A utilizing a space outward of the supply roller 16 in the left-right direction.

(11) According to the developing device 3, as shown in FIGS. 7A and 7B, the developing unit 11 is pivotally movable between the first position in which the developing roller 15 contacts the photosensitive drum 12, and the second position in which the developing roller 15 is separated from the photosensitive drum 12.

Therefore, the developing roller 15 can be placed in contact with the photosensitive drum 12 when supplying toner to the photosensitive drum 12 and can be separated from the photosensitive drum 12 when not supplying toner to the photosensitive drum 12.

(12) According to the developing device 3, as shown in FIGS. 7A and 7B, the developing unit 11 is pivotally movable about the rotational axis of the second conveying member 65.

Accordingly, the second conveying member 65 can be used to pivotally move the developing unit 11.

(13) According to the developing device 3, as shown in FIG. 3, the developing unit 11 is provided with the coupling 70 for transmitting a drive force to the second conveying member 65.

Therefore, this construction can transmit a drive force from the main casing 2 directly to the second conveying member 65.

Thus, the second conveying member 65 can be driven with stability, thereby reliably ensuring a uniform amount of toner in the developing chamber 42.

(14) According to the image forming apparatus 1 shown in FIG. 1, the flat wall 44D of each developing device 3 extends along a path through which the laser beam L from the exposure device 4 passes when the developing unit 11 is in the first position.

Accordingly, the laser beam L emitted from the exposure device 4 can pass along the flat wall 44D and reliably be incident on the photosensitive drum 12.

(15) According to the image forming apparatus 1, as shown in FIGS. 1 and 5, the supply opening 55A is positioned opposite the path of the laser beam L with respect to the second conveying member 65 when viewed in the left-right direction.

This arrangement allocates a path through which the laser beam L can pass while supplying toner into the supply opening 55A from a side opposite the path of the laser beam L.

(16) According to the image forming apparatus 1, as shown in FIGS. 7A and 7B, the second frame 41 is retracted from the path of the laser beam L when the developing unit 11 is in the first position and is advanced into the path of the laser beam L when the developing unit 11 is in the second position.

Accordingly, this configuration allocates a path through which the laser beam L can pass when the developing unit 11 is disposed in the first position shown in FIG. 7A.

When the developing unit 11 is disposed in the second position shown in FIG. 7B, the second frame 41 can be accommodated between the left side plate 31L and the right side plate 31R using a space through which the laser beam L passes.

In this way, the developing device 3 can be made more compact when the developing unit 11 is disposed in the second position.

While the description has been made in detail with reference to the embodiments thereof, it would be apparent to those skilled in the art that many modifications and variations may be made therein without departing from the spirit of the disclosure.

What is claimed is:

1. A developing device comprising:

a casing defining an internal space therein and having a partitioning wall partitioning the internal space into a toner chamber and a developing chamber, the toner chamber accommodating toner therein, the developing chamber being positioned upward of the toner chamber, the partitioning wall having a supply opening and a discharge opening for providing communication between the toner chamber and the developing chamber;

a photosensitive drum configured to rotate about a first axis extending in an axial direction;

a developing roller accommodated in the developing chamber and configured to supply toner to the photosensitive drum, the developing roller being configured to rotate about a second axis;

a supply roller accommodated in the developing chamber and configured to supply toner to the developing roller, the supply roller having a first axial end and a second axial end and being configured to rotate about a third axis positioned downward of the second axis, the supply opening being positioned outside of the first axial end of the supply roller in the axial direction and the discharge opening being positioned outside of the second axial end of the supply roller in the axial direction;

a first conveying member accommodated in the toner chamber and configured to convey the toner accommodated in the toner chamber into the developing chamber through the supply opening, the first conveying member being configured to rotate about a fourth axis positioned downward of the third axis; and a second conveying member accommodated in the developing chamber and configured to convey the toner supplied by the first conveying member from the supply opening to the discharge opening in the axial direction, wherein the first conveying member comprises:

a shaft extending in the axial direction;

a first blade disposed at a position coincident with the supply opening in the axial direction, the first blade extending from the shaft toward an inner surface of the casing; and a second blade positioned closer to the discharge opening than the first blade to the discharge opening in the axial direction, the second blade extending from the shaft toward the inner surface of the casing, the second blade having a flexibility higher than that of the first blade.

2. The developing device according to claim 1, wherein the supply roller comprises:

a supply shaft configured to rotate together with the supply roller; and a supply cover part covering the supply shaft, and wherein the supply opening and the discharge opening are positioned outward of the supply cover part of the supply roller in the axial direction.

3. The developing device according to claim 1, wherein the second conveying member comprises an auger screw.

4. The developing device according to claim 1, wherein the developing roller comprises:

a developing shaft configured to rotate together with the developing roller; and a developing cover part covering the developing shaft, the developing cover part having one end and another end in the axial direction, and wherein the casing includes:

a first seal positioned inward of the supply opening in the axial direction and contacting the one end of the developing cover part; and a second seal positioned inward of the discharge opening in the axial direction and contacting the another end of the developing cover part.

5. The developing device according to claim 1, wherein the second conveying member are juxtaposed with the supply roller in a horizontal direction.

6. The developing device according to claim 1, wherein the first blade has a plate shape and is formed of a flexible resin, and wherein the second blade has a plate shape and is formed of a flexible resin the same as the flexible resin of which the first blade is formed, the second blade having a thickness thinner than that of the first blade.

7. The developing device according to claim 1, wherein the first blade comprises a plurality of blades.

8. The developing device according to claim 1, wherein the casing comprises:

a first accommodating wall accommodating the first blade and having an inner surface formed in an arcuate shape; and a second accommodating wall accommodating the second blade and having an inner surface extending linearly, the second accommodating wall being positioned closer to the discharge opening than the first accommodating wall to the discharge opening in the axial direction.

9. The developing device according to claim 1, wherein the supply opening is positioned between the supply roller and the second conveying member as viewed in the axial direction.

10. A developing device comprising:

a casing defining an internal space therein and having a partitioning wall partitioning the internal space into a toner chamber and a developing chamber, the toner chamber accommodating toner therein, the developing chamber being positioned upward of the toner chamber, the partitioning wall having a supply opening and a discharge opening for providing communication between the toner chamber and the developing chamber;

a photosensitive drum configured to rotate about a first axis extending in an axial direction;

a developing roller accommodated in the developing chamber and configured to supply toner to the photosensitive drum, the developing roller being configured to rotate about a second axis;

a supply roller accommodated in the developing chamber and configured to supply toner to the developing roller, the supply roller having a first axial end and a second axial end and being configured to rotate about a third axis positioned downward of the second axis, the supply opening being positioned outside of the first axial end of the supply roller in the axial direction and the discharge opening being positioned outside of the second axial end of the supply roller in the axial direction;

a first conveying member accommodated in the toner chamber and configured to convey the toner accommodated in the toner chamber into the developing chamber through the supply opening, the first conveying member being configured to rotate about a fourth axis positioned downward of the third axis; and a second conveying member accommodated in the developing chamber and configured to convey the toner supplied by the first conveying member from the supply opening to the discharge opening in the axial direction, wherein the casing is pivotally movable between a first position in which the developing roller contacts the photosensitive drum and a second position in which the developing roller is separated from the photosensitive drum, and wherein the casing is pivotally movable about a rotational axis of the second conveying member.

11. The developing device according to claim 10, wherein the casing includes a coupling configured to transmit a drive force to the second conveying member.

12. An image forming apparatus comprising:

a developing device comprising:

a casing defining an internal space therein and having a partitioning wall partitioning the internal space into a toner chamber and a developing chamber, the toner chamber accommodating toner therein, the developing chamber being positioned upward of the toner chamber, the partitioning wall having a supply opening and a discharge opening for providing communication between the toner chamber and the developing chamber;

a photosensitive drum configured to rotate about a first axis extending in an axial direction;

a developing roller accommodated in the developing chamber and configured to supply toner to the photosensitive drum, the developing roller being configured to rotate about a second axis;

a supply roller accommodated in the developing chamber and configured to supply toner to the developing roller, the supply roller being configured to rotate about a third axis positioned downward of the second axis, the supply opening and the discharge opening being positioned outward of the supply roller in the axial direction;

a first conveying member accommodated in the toner chamber and configured to convey the toner accommodated in the toner chamber into the developing chamber through the supply opening, the first conveying member being configured to rotate about a fourth axis positioned downward of the third axis, the first conveying member comprising:

a shaft extending in the axial direction;

a first blade disposed at a position coincident with the supply opening in the axial direction, the first blade extending from the shaft toward an inner surface of the casing; and a second blade positioned closer to the discharge opening than the first blade to the discharge opening in the axial direction, the second blade extending from the shaft toward the inner surface of the casing, the second blade having a flexibility higher than that of the first blade; and a second conveying member accommodated in the developing chamber and configured to convey the toner supplied by the first conveying member from the supply opening to the discharge opening in the axial direction, the casing comprising:

a first accommodating wall accommodating the first blade and having an inner surface formed in an arcuate shape; and a second accommodating wall accommodating the second blade and having an inner surface extending linearly, the second accommodating wall being positioned closer to the discharge opening than the first accommodating wall to the discharge opening in the axial direction; and an exposure unit positioned downward of the casing, the exposure unit being configured to emit a laser beam to expose the photosensitive drum to the laser beam, the second accommodating wall extending along a path through which the laser beam passes.

13. The image forming apparatus according to claim 12, wherein the supply opening is positioned opposite the path through which the laser beam passes with respect to the second conveying member as viewed in the axial direction.

14. The image forming apparatus according to claim 12, wherein the casing is pivotally movable between a first position in which the developing roller contacts the photosensitive drum and a second position in which the developing roller is separated from the photosensitive drum, and wherein the casing is retracted from the path through which the laser beam passes when the casing is in the first position, and advances into the path through which the laser beam passes when the casing is in the second position.

* * * * *